US006873864B2

(12) United States Patent
Kai et al.

(10) Patent No.: US 6,873,864 B2
(45) Date of Patent: Mar. 29, 2005

(54) SUPERCONDUCTIVE FILTER MODULE, SUPERCONDUCTIVE FILTER ASSEMBLY AND HEAT INSULATING TYPE COAXIAL CABLE

(75) Inventors: Manabu Kai, Kawasaki (JP); Kazunori Yamanaka, Kawasaki (JP); Tsuyoshi Hasegawa, Kawasaki (JP); Toru Maniwa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 68 days.

(21) Appl. No.: 09/925,879

(22) Filed: Jul. 26, 2001

(65) Prior Publication Data

US 2002/0038720 A1 Apr. 4, 2002

Related U.S. Application Data

(63) Continuation of application No. PCT/JP99/00933, filed on Feb. 26, 1999.

(51) Int. Cl.[7] ..... H01P 1/20; H01B 12/02

(52) U.S. Cl. ..... 505/210; 505/700; 505/701; 505/866; 333/99.005; 333/202

(58) Field of Search ..... 333/203, 202, 333/995; 505/210, 700, 706, 866

(56) References Cited

U.S. PATENT DOCUMENTS 4,034,319 A * 7/1977 Olsson ..... 333/203
5,120,705 A * 6/1992 Davidson et al. ..... 333/995 X
5,179,074 A * 1/1993 Fiedziuszko et al. ... 333/995 X
5,304,962 A * 4/1994 Bobadilla et al. ..... 333/203 X
5,838,213 A * 11/1998 Huang ..... 333/202 X
6,470,198 B1 * 10/2002 Kintaka et al. ..... 333/995 X
6,546,266 B1 * 4/2003 Okazaki et al. ..... 333/995 X

FOREIGN PATENT DOCUMENTS

| | | | |
|---|---|---|---|
| GB | 2235828 A * | 3/1991 | ..... 333/995 |
| JP | 08-222915 | 8/1996 | |
| JP | 09-129041 | 5/1997 | |
| JP | 09-147634 | 6/1997 | |
| JP | 09-298404 | 11/1997 | |

* cited by examiner

*Primary Examiner*—Benny T. Lee
(74) *Attorney, Agent, or Firm*—Katten Muchin Zavis Rosenman

(57) ABSTRACT

The present invention relates to superconductive filter technology. According to the arrangement of the superconductive filter (1), a columnar resonating member (23) having a superconductive material formed on the surface thereof is attached at one of its ends thereof to an inner wall (22) of a filter housing (21) so that a space is interposed between the columnar resonating member and each of connectors (27*a*, 27*b*) which are connectable to a signal input/output cables (5*a*, 5*b*), respectively. According to this arrangement, heat conduction from the outside can be suppressed as far as possible, and the superconductive condition can be created with stability, with the result that a stable filtering characteristic can be created. Further, the superconductive filter according to the present invention will become excellent in power withstand performance, and hence even if the number of stages of filters is increased for attaining a steep cutoff characteristic, the loss deriving from the increased number of stages can be suppressed to the minimum level.

31 Claims, 16 Drawing Sheets

SUPERCONDUCTIVE FILTER MODULE, SUPERCONDUCTIVE FILTER ASSEMBLY AND HEAT INSULATING TYPE COAXIAL CABLE

This is a continuation of PCT/JP99/00933 filed Feb. 26, 1999.

TECHNICAL FIELD

The present invention relates to a superconductive filter module, a superconductive filter assembly and a heat insulating type coaxial cable, and more particularly to a superconductive filter module, a superconductive filter assembly and a heat insulating type coaxial cable suitable for use with mobile communication equipment.

BACKGROUND ART

Recently, the number of users of mobile communication equipment is increasing rapidly, and hence there has been greater demand for more effective utilization of limited width frequency bands. For this reason, a band-pass filter (in particular, a filter utilized on the side of a base station under a microwave band environment) is required to have a steep cutoff characteristic and a low power loss performance in the pass-band. To implement a filter having a steep cutoff characteristic under a microwave band environment, the number of filter stages shall be increased. However, if the filter is composed of an ordinary conductive metal, the power loss in the pass band becomes excessively large.

If the filter employs a superconductive material which has a low surface resistance in the microwave band, the filter will have very little loss in the pass-band. Particularly, there are many reports available in which it is stated that a so-called "superconductive microstrip filter" has achieved a filter which makes it easy to design the arrangement thereof and attain miniaturization of the same.

FIG. 15 is a plan view schematically showing a superconductive microstrip filter. As shown in FIG. 15, a superconductive microstrip filter 50 has a dielectric substrate 53 (made of MgO or the like) having a desired line pattern of a superconductive film (superconductive signal line portion) 5l*a*, 51*b* and 52 formed by means of lithography or the like, an input connector 54*a* to which a signal input coaxial cable can be connected, and an output connector 54*b* to which a signal output coaxial cable can be connected. FIG. 16 is a cross sectional view taken along the line A—A on the superconductive film 52 (51*a* and 51*b*) shown in FIG. 15.

The above-described input connector 54*a* is bonded together with the superconductive film 51*a* at a center conductor 55 thereof by using a solder or the like so that when the input connector 54*a* is connected with the coaxial cable 65*a* (See FIG. 15), an input microwave can be transmitted through the coaxial cable 65*a* and led into the superconductive film 51*a*. Similarly, the output connector 54*b* is bonded together with the superconductive film 51*b* at a 55 center conductor 55 thereof by using a solder or the like so that a microwave outputted through the superconductive film 51*b* can be inputted into the coaxial cable 65*b* (See FIG. 15). In FIG. 15 reference numerals 55*a* and 55*b* designate these bonding portions.

Each of the superconductive films 52 (See FIG. 15) is optimally designed in its length and the distance from it to the neighboring superconductive film 52 (forming a coupling capacity together with that superconductive film) so that the superconductive film serves as a resonator which resonates a particular frequency (or wavelength) component in the frequency band of the input microwave components introduced into the above-described superconductive film 51*a*. In this way, only the particular frequency (or wavelength) component in the frequency band of the input microwave components introduced into the above-described superconductive film 51*a* is resonated in each of the superconductive films 52 and propagated to the adjacent superconductive film 52. Finally, the particular frequency component in the frequency band is extracted from the superconductive film Sib and outputted through the output connector 54*b* to the coaxial cable 65*b*.

In the above example, the number of pieces of the superconductive film 52 (in the example shown in FIG. 15, the number is five) corresponds to the filter stage number which decides the cutoff characteristic of the filter assembly. As the number of filter stages is increased, the cutoff characteristic becomes steeper. The above superconductive films 51*a*, 51*b*, 52 are formed of a superconductive material (chemical compound) composed of YBCO (i.e., Y—Ba—Cu—O: in this case, symbol Y represents yttrium, Ba barium, Cu copper, and O oxygen, respectively).

When the above-described superconductive micro-strip filter 50 (hereinafter sometimes simply denoted as "superconductive filter 50") is operated, the filter is housed within a package 61 made of an ordinary conductivity metal having a high thermal conductivity and a low thermal expansion (shrinkage) ratio such as copper, INVER or the like, as schematically shown in FIG. 17. Then, the package 61 is disposed on a cold head (cooling medium) 63 provided in a vacuum heat insulating vessel 62 (reference numeral 64 represents a vacuum space). The cold head 63 is connected to a refrigerator not shown and the superconductive films 51*a*, 51*b* and 52 are cooled (to about 70K (Kelvin)) by the refrigerator, whereby the superconductive films are placed in a superconductive state.

The structure 67 shown in FIG. 17 is hereinafter referred to as "superconductive filter module 67". FIG. 17 schematically shows the superconductive filter module 67 in which only the vacuum heat insulating vessel 62 is shown as a cross-sectional side view (that is, FIG. 17 includes the superconductive filter 51 as viewed from the arrow B in FIG. 15). Further, in FIG. 17, reference numerals 65*c* and 65*d* represent coaxial cables similarly arranged to the coaxial cables 65*a* and 65*b*, and these coaxial cables are connected to the coaxial cables 65*a* and 65*b* through the connectors 62*a* and 62*b* provided on the vacuum heat insulating vessel 62, respectively.

Meanwhile, as an index indicative of the performance of the refrigerator, there is a refrigerator output. This index corresponds to a heat amount flowing into the vessel as a heat load allowable for the refrigerator to keep the cooling object at a low constant temperature. If the requested cooling condition is a cooled state at a temperature of 70K, the value of the index is set to about several W (watt) in terms of reasonable balance with the power consumption of the refrigerator.

It is true that, in the above-described conventional superconductive filter module 67, it is attempted to keep the package 61 at a constant low temperature (about 70K) within the vacuum heat insulating vessel 62 with the refrigerator. However, as described above, the center conductors 55 of the input connector 54*a* and the output connector 54*b* are bonded together with the superconductive films 51*a* and 51*b* by means of solder or the like (bonding connection). Thus, heat flows from the coaxial cables 65*c* and 65*d* which are exposed under the external temperature (room temperature) outside the vacuum heat insulating vessel 62 through the coaxial cables 62*a* and 62*b* (external conductors mainly constituting the coaxial cables 62*a* and 62*b*) into the package, leading to temperature increase at the bonding portions 55*a* and 55*b*, with the result that the surface resistance of the superconductive films 51*a* and 51*b* is increased at the bonding portion. As a result, the whole loss of the superconductive filter 50 is increased.

Further, the bonding materials utilized at the bonding portions 55*a* and 55*b* differ from each other in thermal expansion coefficient. Thus, the bonding portions 55*a* and 55*b* will suffer from damage, for example, under low temperature conditions such as of 70K, and contact at the bonding portion becomes unsatisfactory, with the result that the bonding state becomes unstable. This means that a desired filtering characteristic cannot be obtained.

Furthermore, according to the above arrangement, metal surfaces (conductive materials) contact each other throughout the external conductors of the coaxial cables 65*a* and 65*b*, the input connector 54*a*, the output connector 54*b*, the package 61, and the cold head 63. Therefore, heat can be conducted from the outside through the metal surface connection and finally allowed to flow into the refrigerator, thereby increasing the load imposed on the refrigerator.

Although the amount of heat flowing into the package per coaxial cable depends on the material thereof, the dimension thereof or the like, it can be estimated to be about 1 W. However, a single refrigerator unit can be connected with several cables such as cables for input and output, cables for transmission and reception, and so on. In some cases, the single refrigerator unit can be connected with several tens of cables for each communication channel or sector, depending on the arrangement of the communication system.

In this case, the total amount of heat conducted from the outside to the refrigerator will far exceed the permissible amount of heat [several W (watt)] flowing into the refrigerator, with the result that the superconductive filter 50 cannot be maintained in the superconductive state satisfactorily (i.e., the loss becomes large).

Furthermore, when an electric current is allowed to flow in the superconductive film 52 (51*a*, 51*b*) of the single unit of the superconductive filter 50, the electric current density profile becomes one in which the current flows intensively at the edge 52*a* thereof as shown with an imaginary line in FIG. 16 (i.e., the current density becomes high at the edge 52*a*). This phenomenon is referred to as "edge effect"). For this reason, not only the Q-value (index of sharpness of passing characteristic) of the superconductive filter 50 but also the power withstand performance of the superconductive filter 50 are limited. For example, the above-described superconductive filter 50 has a power withstand performance of about several watts. Thus, this filter is applicable to receiving side of radio communication equipment (e.g., a base station) but not applicable to the transmission side of the same in which power withstand performance of several tens to several hundreds or more is required.

The present invention was made in view of the above. Therefore, it is an object of the invention to provide a superconductive filter module and a superconductive filter assembly in which heat conduction from the outside can be suppressed as far as possible, the superconductive condition can be created with stability, with the result that a stable filtering characteristic can be created, and power withstand performance becomes excellent, and hence even if the number of stages of filters is increased to attain a steep cutoff characteristic, the loss deriving from the increased number of stages can be suppressed to the minimum level.

Also, an object of the present invention is to provide a heat insulating type coaxial cable which can suppress heat flow into a superconductive device such as a superconductive filter assembly to the minimum level.

SUMMARY OF THE INVENTION

Therefore, according to the present invention, there is provided a superconductive filter module including a vacuum heat insulating vessel, a superconductive filter assembly provided in the vacuum heat insulating vessel and composed of a filter housing having a signal input connector at which a filter input radio frequency signal is inputted and a signal output connector from which a filter output radio frequency signal is outputted and a columnar resonating member attached to the inner wall of the filter housing at one end thereof so as to be spaced apart from the signal input connector and the signal output connector so that a filter output radio frequency signal component outputted from the signal output connector selected from the filter input radio frequency signal components inputted through the signal input connector is brought into a resonance mode in the filter housing, the columnar resonating member being coated with a superconductive material on at least the surface thereof, a cooling medium provided in the vacuum heat insulating vessel so that the superconductive filter assembly is disposed thereon and capable of cooling the superconductive filter assembly so that the superconductive filter assembly can be operated under a superconductive state, a signal input cable connected to the signal input connector of the superconductive filter assembly so that a filter input radio frequency signal to be inputted into the signal input connector can be transmitted to the inside of the filter assembly, the signal input cable having a heat insulating portion capable of insulating heat conductance into the superconductive filter assembly provided at a proper portion within the vacuum heat insulating vessel, and a signal output cable connected to the signal output connector of the superconductive filter assembly so that a filter output radio frequency signal extracted from the signal output connector can be transmitted to the outside of the filter assembly, the signal output cable having a heat insulating portion capable of insulating heat conductance into the superconductive filter assembly provided at a proper portion within the vacuum heat insulating vessel.

In this case, the columnar resonating member may have any one of a circular cross-section, an elliptical cross-section and a polygonal cross-section. Further, each of the filter housing and the columnar resonating member may be made of ordinary conductive material, the inner wall of the filter housing and the surface of the columnar resonating member may be applied with metal plating, and a superconductive film made of superconductive material may be formed on the surface of the metal plating.

Also, the filter housing may have on its inner wall a center frequency adjusting member for adjusting the space amount formed between the inner wall of the filter housing and the other end of the columnar resonating member so as to adjust the coupling capacity between the inner wall of the filter housing and the other end of the columnar resonating member, whereby the center frequency of the filtering frequencies can be adjusted. Further, the surface of the center frequency adjusting member may be made of a superconductive material. Furthermore, the center frequency adjusting member may be made of ordinary conductive material, the surface of the center frequency adjusting member may be applied with metal plating, and a superconductive film made of superconductive material may be formed on the surface of the metal plating.

Further, if a plurality of columnar resonating members are provided with a regular interval interposed therebetween so as to form an array on the inner wall of the filter housing, the filter housing may have on its inner wall a bandwidth adjusting member for adjusting the space amount formed between the columnar resonating members so as to adjust the coupling capacity between the columnar resonating members, whereby the bandwidth of the filtering frequencies can be adjusted. Furthermore, the surface of the bandwidth adjusting member may be made of a superconductive material. Also, the bandwidth adjusting member may be made of ordinary conductive material, the surface of the bandwidth adjusting member may have metal plating applied, and a superconductive film made of superconductive material may be formed on the surface of the metal plating.

Further, the ordinary conductive material may be any material so long as it is either copper type material or nickel type material, for example. Further, the metal plating may be any material so long as it is made of any one of silver type material, gold type material or nickel type material, for example. Furthermore, the superconductive material may be any material so long as it is made of any one of YBCO, NBCO, BSCCO, BSCCO, BPSCCO, HBCCO, and TBCCO, for example.

Further, the signal input connector and the signal output connector may have signal coupling units provided in the filter housing so as to be opposite to and be spaced apart from the columnar resonating member, respectively. In this case, each of the signal coupling units may be provided with a signal coupling flat member or a signal coupling loop member.

Further, each of the signal input cable and the signal output cable may be arranged as a heat insulating coaxial cable composed of a center conductor, an insulating member coating the center conductor, and an external conductor provided on the periphery of the insulating member so as to have a heat insulating portion. In this case, the heat insulating portions may be provided at a plurality of proper positions of the external conductor within the vacuum heat insulating vessel.

The external conductor may be arranged to coat the insulating member so that a part of the periphery thereof is exposed. In this case, the insulating member may be covered at the exposed portion with a metal plating as a heat insulating portion having a thickness smaller than the thickness of the external conductor coating the insulating member on the outer periphery thereof. Also, the insulating member may be provided at the exposed periphery portion with an electrostatic capacity element which couples ends of the external conductor coating the insulating member on the outer periphery thereof to each other, and the exposed periphery portion may be made to serve as the heat insulating portion.

When the external conductor is arranged to coat the insulating member so that a part of the periphery thereof is exposed, and at the exposed peripheral portion of the insulating member both the opposing ends of the external conductor coating the insulating member at the periphery thereof may be formed into comb-shaped portions and opposed to each other in an interdigitating fashion so that a coupling capacity is created thereat and the opposing external conductor portion formed into the comb-shaped portions may be made to serve as the heat insulating portion.

The external conductor may be composed of a metal plating layer coating the insulating member at the outer periphery thereof and a resin layer coating the metal plating layer, and at least the metal plating layer also may be made to serve as the heat insulating portion. Also, the external conductor may be arranged as a strap-like conductive member coiling around the outer periphery of the insulating member with a part of the outer periphery of the insulating member left uncovered, and the strap-like conductive member coiling around the outer periphery of the insulating member may be made to serve as the heat insulating portion.

Further, the external conductor may be arranged as a meander-shaped conductive sheet member coiling around the outer periphery of the insulating member with a part of the outer periphery of the insulating member left uncovered, and the meander-shaped conductive sheet member coiling around the outer periphery of the insulating member may be made to serve as the heat insulating portion.

According to the present invention, there is provided a superconductive filter assembly including a filter housing, a signal input connector attached to the filter housing and connectable to a signal input cable for transmitting a filter input radio frequency signal, a signal output connector attached to the filter housing at a position different from the position at which the signal input connector is attached, and connectable to a signal output cable for transmitting a filter output radio frequency signal, and a columnar resonating member attached on the inner wall of the filter housing at one end thereof so as to be spaced apart from the signal input connector and the signal output connector so that a filter output radio frequency signal component selected from the filter input radio frequency signal components is brought into a resonance mode in the filter housing, the columnar resonating member being coated with a superconductive material on at least the surface thereof.

In this case, the columnar resonating member may have any one a circular cross-section, an elliptical cross-section and a polygonal cross-section. Further, each of the filter housing and the columnar resonating member may be made of ordinary conductive material, the inner wall of the filter housing and the surface of the columnar resonating member may have metal plating applied, and a superconductive film made of superconductive material may be formed on the surface of the metal plating.

Further, the filter housing may have on its inner wall a center frequency adjusting member for adjusting the space amount formed between the inner wall of the filter housing and the other end of the columnar resonating member so as to adjust the coupling capacity between the inner wall of the filter housing and the other end of the columnar resonating member, whereby the center frequency of the filtering frequencies can be adjusted, the surface of the center frequency adjusting member being made of a superconductive material. Further, the center frequency adjusting member may be made of ordinary conductive material, the surface of the center frequency adjusting member may have metal plating applied, and a superconductive film made of superconductive material may be formed on the surface of the metal plating.

Further, a plurality of columnar resonating members may be provided with a regular interval interposed therebetween so as to form an array on the inner wall of the filter housing. Also in this case, the filter housing may have on its inner wall a bandwidth adjusting member for adjusting the space amount formed between the columnar resonating members so as to adjust the coupling capacity between the columnar resonating members, whereby the bandwidth of the filtering frequencies can be adjusted, the surface of the bandwidth adjusting member being made of a superconductive material. The bandwidth adjusting member may be made of ordinary conductive material, the surface of the bandwidth adjusting member may have metal plating applied, and a superconductive film made of superconductive material may be formed on the surface of the metal plating.

Further, also in this case, the ordinary conductive material may be any material so long as it is either copper type material or nickel type material, for example. Further, the metal plating may be any material so long as it is made of any one of silver type material, gold type material or nickel type material, for example. Furthermore, the superconductive material may be any material so long as it is made of any one of YBCO, NBCO, BSCCO, BSCCO, BPSCCO, HBCCO, and TBCCO, for example.

Also, the signal input connector and the signal output connector may have signal coupling units provided in the filter housing so as to be opposite to and be spaced apart from the columnar resonating member, respectively. In this case, each of the signal coupling units may be provided with a signal coupling flat member or a signal coupling loop member.

Next, according to the present invention, there is provided a heat insulating type coaxial cable for use with a superconductive filter assembly including a filter housing having a signal input connector at which a filter input radio frequency signal is inputted and a signal output connector from which a filter output radio frequency signal is outputted, and a columnar resonating member coated with a superconductive material on at least the surface thereof so as to bring into a resonance mode in the filter housing, a filter output radio frequency signal component outputted from the signal output connector selected from the filter input radio frequency signal components inputted through the signal input connector, the coaxial cable being connectable to the signal input connector or the signal output connector. The heat insulating type coaxial cable is arranged to include a center conductor, an insulating member coating the center conductor, and an external conductor attached on the outer periphery of the insulating member and provided at a proper position thereof with a heat insulating portion capable of insulating against heat being conducted into the superconductive filter assembly.

In this case, the heat insulating portions may be provided at a plurality of proper positions of the external conductor within the vacuum heat insulating vessel. If the external conductor is arranged to coat the insulating member so that a part of the periphery thereof is exposed, the insulating member may be covered at the exposed portion with a metal plating as a heat insulating portion having a thickness smaller than the thickness of the external conductor coating the insulating member on the outer periphery thereof. Also, the insulating member may be provided at the exposed periphery portion with an electrostatic capacity element which couples ends of the external conductor coating the insulating member on the outer periphery thereof to each other, and the exposed periphery portion may be made to serve as the heat insulating portion.

Further, if the external conductor is arranged to coat the insulating member so that a part of the periphery thereof is exposed, then at the exposed peripheral portion of the insulating member, both the opposing ends of the external conductor coating the insulating member at the periphery thereof may be formed into comb-shaped portions and opposed to each other in an interdigitating fashion so that a coupling capacity is created at the comb-shaped portions and the opposing external conductor portions formed into the comb-shaped portions serving as the heat insulating portion.

Further, the external conductor may be composed of a metal plating layer coating the insulating member at the outer periphery thereof and a resin layer coating the metal plating layer, and at least the metal plating layer may also be made to serve as the heat insulating portion.

Furthermore, the external conductor may be arranged as a strap-like conductive member coiling around the outer periphery of the insulating member with a part of the outer periphery of the insulating member left uncovered, and the strap-like conductive member coiling around the outer periphery of the insulating member may also be made to serve as the heat insulating portion.

Further, the external conductor may be arranged as a meander-shaped conductive sheet member coiling around the outer periphery of the insulating member with a part of the outer periphery of the insulating member left uncovered, and the meander-shaped conductive sheet member coiling around the outer periphery of the insulating member may also serve as the heat insulating portion.

Next, according to the present invention, there is provided a heat insulating type coaxial cable connectable to a superconductive device at least one composing element of which is operated under a superconductive state, including a center conductor, an insulating member coating the center conductor, and an external conductor attached on the outer periphery of the insulating member and provided at a proper position thereof with a heat insulating portion capable of insulating against heat being conducted into the superconductive filter assembly.

As described above, according to the present invention, the columnar resonating member constituting the superconductive filter is attached to the inner wall of the filter housing at one end thereof so as to be spaced apart from each of the connectors to which the signal input/output cables are connected, respectively. Moreover, the columnar resonating member is coated with a superconductive material on at least the surface thereof. The following advantages can be obtained.

(1) Heat conducted through the coaxial cable can be prevented from being conducted to the columnar resonating member which has the superconductive material applied on the surface thereof. Thus, the superconductive state can be satisfactorily maintained with stability. Therefore, stable and satisfactory filter characteristics can be obtained.

(2) The columnar resonating member has the superconductive material applied on the surface thereof. Therefore, even if the number of filter stages (i.e., the number of columnar resonating members) is increased so that the filtering cutoff characteristic is made to be steep, the filtering loss can be suppressed to the minimum. Therefore, it becomes possible to realize a filter having a low loss and steep filtering cutoff characteristic with ease.

Moreover, the above-described cable is arranged as a heat insulating type coaxial cable having an external conductor which has a heat insulating portion capable of insulating heat from being conducted into the superconductive filter assembly. Therefore, it becomes possible to suppress heat conductance through the coaxial cable external conductor into the superconductive filter assembly to the minimum. Furthermore, the superconductive state of the superconductive filter assembly can be maintained stably and satisfactorily, and cooling load necessary for maintaining the superconductive state can be remarkably reduced.

In this case, if the columnar resonating member has any of a circular cross-section, an elliptical cross-section or a polygonal cross-section, the electric current density profile can be free from a state of "edge effect" in which the current is allowed to flow intensively at the edge thereof. Thus, the power withstand performance can be remarkably increased.

Furthermore, if the filter housing and the columnar resonating member are made of an ordinary conductive material and the filter housing and the columnar resonating member are applied with metal plating on the surfaces thereof and a superconductive film using a superconductive material is formed on the surface of the metal plating, it becomes possible to form a superconductive material surface on the inner wall of the filter housing and the surface of the columnar resonating member with ease and low cost. Also in this case, since the inner wall of the filter housing is formed of the superconductive material, the filtering loss can be further reduced.

If the filter housing is provided on its inner wall with the center frequency adjusting member having a superconductive material applied on the surface thereof, it becomes possible to adjust the center frequency of the filter while the low loss property is maintained. Therefore, a low loss filter having a desired filtering center frequency can be implemented with ease.

If the center frequency adjusting member is made of an ordinary conductive member, a metal plating may also be applied on the surface of the member and further a superconductive film using a superconductive material may be formed on the surface of the metal plating. According to this arrangement, the surface of the center frequency adjusting member can be formed of the superconductive material with ease and low cost.

Further, if a plurality of columnar resonating members are provided with a regular interval interposed therebetween so as to form an array on the inner wall of the filter housing, the band width adjusting member having the superconductive material coating the surface thereof may be provided on the inner wall of the filter housing. In this arrangement, the bandwidth of the filtering frequency can be adjusted while the low loss property is maintained. Therefore, a low loss filter having a desired filtering bandwidth can be implemented with ease.

If the bandwidth adjusting member is made of an ordinary conductive member, also a metal plating may be applied on the surface of the member and further a superconductive film using a superconductive material may be formed on the surface of the metal plating. According to this arrangement, the surface of the bandwidth adjusting member can be formed of the superconductive material with ease and low cost.

Meanwhile, the above-introduced ordinary conductive material include either copper material or nickel material, for example. These materials have very high adaptability for realizing the invention. Further, the above metal plating may include one of silver material, gold material or nickel material, for example. These materials have high adaptability for realizing the invention, and these materials make it easy to form the superconductive film on the surface thereof. Also, the superconductive material may be one of YBCO, NBCO, BSCCO, BSCCO, BPSCCO, HBCCO and TBCCO, for example. These materials have high adaptability for realizing the invention.

Furthermore, the signal input/output connectors may have the signal coupling units provided in the filter housing so as to be opposite to and be spaced apart from the columnar resonating member, respectively. With this arrangement, heat conduction to the columnar resonating member can be suppressed, signals can be effectively led to the columnar resonating member, and a signal can be effectively extracted from the columnar resonating member.

In this case, the signal coupling unit may be formed of the signal coupling flat member or the signal coupling loop member. With this arrangement, the introduction and extraction of the signal can be more effectively carried out.

Further, the cables for signal input/output (heat insulating type coaxial cable) may be arranged to have the heat insulating portions provided at a plurality of proper positions of the external conductor (within the vacuum heat insulating vessel). With this arrangement, the superconductive filter assembly will have a more improved heat conduction insulating performance.

In this case, the external conductor may be arranged to coat the insulating member so that a part of the periphery thereof is exposed, and the insulating member may be covered at the exposed portion with the metal plating as a heat insulating portion having a thickness smaller than the thickness of the external conductor coating the insulating member on the outer periphery thereof. With this arrangement, the cross-sectional area of the metal plating portion can be remarkably reduced without degrading the electric characteristic of the coaxial cable. Therefore, the heat conduction to the superconductive filter assembly can be reliably suppressed.

Further, the external conductor may be arranged to coat the insulating member so that a part of the periphery thereof is exposed, the insulating member may be provided with the capacity element as the heat insulating portion which couples the ends of the external conductor coating the insulating member on the outer periphery portion thereof to each other. With this arrangement, the electric characteristic of the coaxial cable can be maintained owing to the capacity element. In addition, in this case, since the external conductor comes to have a discontinuous portion, the heat insulating effect can be further improved.

Further, the external conductor may be arranged to coat the insulating member so that a part of the periphery thereof is exposed, and at the exposed peripheral portions of the insulating member, both the opposing ends of the external conductor coating the insulating member at the periphery thereof may be formed into comb-shaped portions and opposed to each other in an interdigitating fashion so that a coupling capacity is created at the comb-shaped portions and the opposing external conductor portions formed into the comb-shaped portions serve as the heat insulating portion. Also with this arrangement, the electric characteristic of the coaxial cable can be maintained owing to the coupling capacity. In addition, since the external conductor is forced to have a completely discontinuous portion, the heat insulating effect can be further improved.

Further, the external conductor may be composed of a metal plating layer coating the insulating member at the outer periphery thereof and a resin layer coating the metal plating layer, and at least the metal plating layer may be made to serve as the heat insulating portion. With this arrangement, the cross-sectional area of the external conductor can be made small, and hence the heat insulating effect can be improved and the strength of the coaxial cable itself can be improved.

Further, the external conductor may be arranged as the strap-like conductive member coiling around the outer periphery of the insulating member with a part of the outer periphery of the insulating member left uncovered, and the strap-like conductive member coiling around the outer periphery of the insulating member may be made to serve as the heat insulating portion. With this arrangement, the external conductor serving as the heat conducting path is formed into a coiling shape and elongated. Therefore, the heat insulating effect will be further improved.

Furthermore, the external conductor may be arranged as a meander-shaped conductive sheet member coiling around the outer periphery of the insulating member with a part of the outer periphery of the insulating member left uncovered, and the meander-shaped conductive sheet member coiling around the outer periphery of the insulating member may be made to serve as the heat insulating portion. With this arrangement, the external conductor serving as the heat conducting path is further elongated and hence a greater heat insulating effect can be expected.

The above heat insulating type coaxial cable is applicable to any type of superconductive device to obtain a similar advantage.

DETAILED DESCRIPTION OF THE PRESENT INVENTION

Embodiments of the present invention will be hereinafter described with reference to drawings.

(A) Description of Superconductive Filter Assembly

Figure 1:
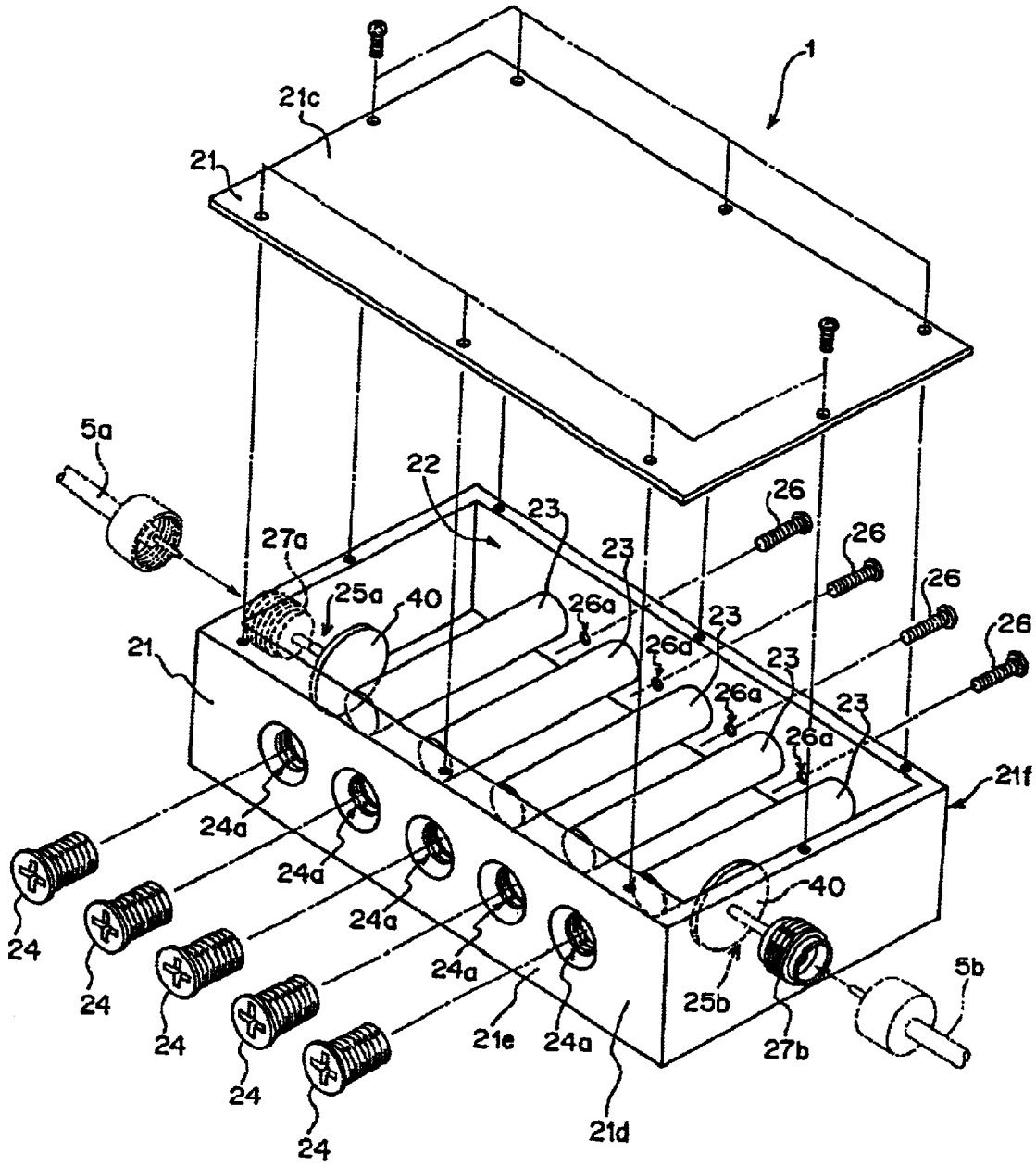
FIG. 1 is an exploded perspective view schematically showing a superconductive filter assembly (band-pass filter) as one embodiment of the present invention.
Figure 2:
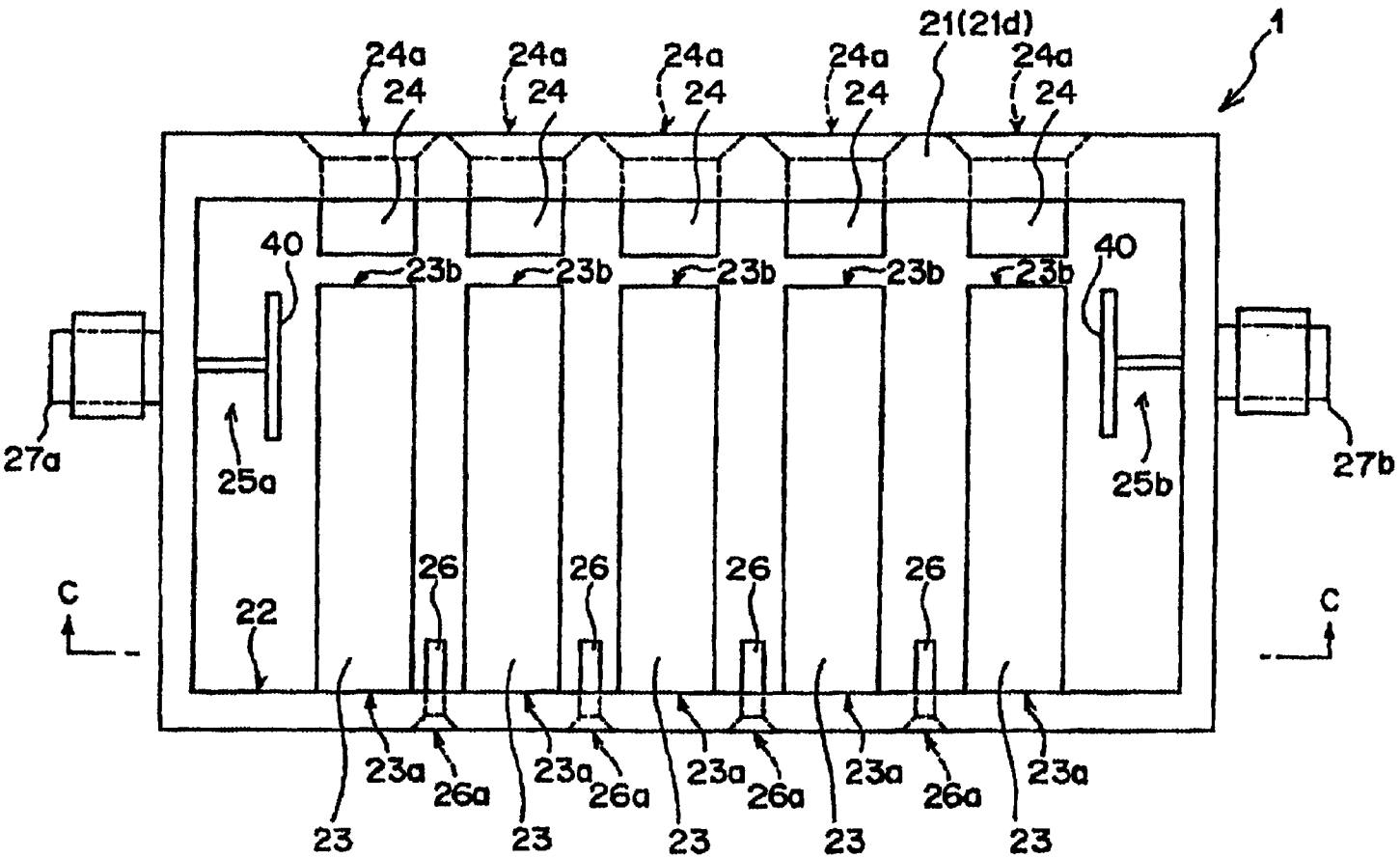
FIG. 2 is a plan view schematically showing the superconductive filter assembly shown in FIG. 1 in a state in which a lid thereof is uncovered.

FIG. 1 is an exploded perspective view schematically showing a superconductive filter assembly (band-pass filter) as one embodiment of the present invention. FIG. 2 is a plan view schematically showing the superconductive filter assembly shown in FIG. 1. As shown in FIGS. 1 and 2, the superconductive filter assembly (band-pass filter) 1 of the present embodiment is arranged to include a signal input connector 27*a* and a signal output connector 27*b* each of which a coaxial cable can be connected to, a vessel 21*d* provided with the signal input connector and signal output connector, and a filter housing 21 which is composed of the vessel 21*d* and a lid 21*c* fixed to the vessel 21*d* by a screw.

The filter housing 21 is provided with a proper number of metal rods 23 (in the example shown in FIGS. 1 and 2, the number is five) attached to an inner wall 22 at one end 23*a* thereof (see FIG. 2), frequency adjusting screws 24 attached to respective aperture portions 24*a* provided on a side portion 21*e* (see FIG. 2. 1) of the housing so that the frequency adjusting screws are brought into opposition to the metal rods 23, respectively, a pair of signal coupling units 25*a* and 25*b* attached to the respective connectors 27*a* and 27*b* so that the signal coupling units are brought into opposition to the metal rods 23 with a space interposed therebetween, coupling capacity adjusting screws 26 provided between each of the metal rods 23 through respective hole aperture portions 26*a* provided in a side portion 21*f* of the housing opposing to the side portion 21*e* (See FIG. 1). The filter assembly having the above construction is ordinarily referred to as a coaxial type (semi-coaxial type) filter.

Figure 4:
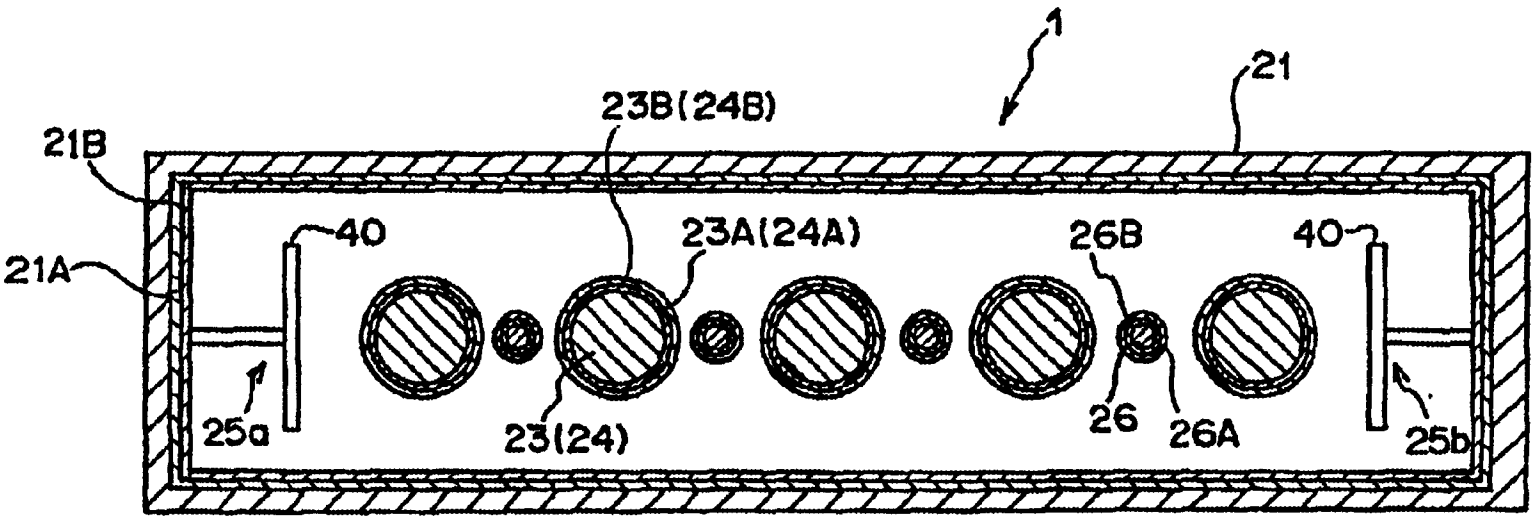
FIG. 4 is a diagram showing a cross section taken along the line C—C of the filter assembly shown in FIG. 2.

The filter housing 21 (hereinafter simply referred to as "housing 21") is made of a known ordinary conductive material (e.g., copper). In the present embodiment, as for example schematically shown in FIG. 4, the entire inner surface (inner wall 22) is covered with a metal plating (e.g., silver plating using a silver type material) 21A, and on the surface of the silver plating 21A, a superconductive film 21B employing a superconductive material [e.g., a material having a composition of BSCCO (i.e., Bi—Sr—Ca—Cu—O: reference symbol Bi represents bismuth, Sr strontium, Ca calcium, Cu copper, and O oxygen, respectively)] is formed. The silver plating 21A is applied prior to the formation of the superconductive film 21B. This is because the silver plating makes it easy to form the superconductive film 21B. FIG. 4 is a cross-sectional view taken along line C—C of the superconductive filter assembly 1 shown in FIG. 2.

Furthermore, each of the metal rods (columnar resonating member) 23 functions as a resonator. That is, when a microwave (filter input radio frequency signal) containing a desired frequency component is supplied to the filter assembly through the connector 27*a* (signal coupling unit 25*a*), the metal rods make a signal (filter output radio frequency signal component) of the particular wavelength component contained in the microwave resonate so that only a signal of a particular frequency band is propagated (passed) to the opposing signal coupling unit 25*b* (connector 27*b*). For this reason, each of the rods is arranged to have a length corresponding to the particular wavelength component. Further, as shown in FIGS. 1 and 2, the metal rods are attached to the inner wall 22 of the housing 21 so as to form an array having a predetermined interval interposed between them.

Also, each of the metal rods 23 is made of a known ordinary conductive material such as copper. According to the present embodiment, as for example shown in FIG. 4, each of the metal rods is arranged to have a solid circular cross-section with a diameter of five to six millimeters. Similarly to the inner wall 22 of the housing 21, the metal rods are applied with a silver metal plating 23A on the surface thereof, and further a superconductive film 23B employing a superconductive material (BSCCO) is formed on the surface of the silver plating 23A. Each of the metal rods 23 may be formed to have a hollow circular cross-section (i.e., cylindrical shape).

As described above, if the metal rod 23 functioning as a resonator has the superconductive film 23*b* formed on the surface thereof, the surface resistance thereof comes to have a value of one tenth to one thousandth the surface resistance of an ordinary conductive material or smaller, even if the resonator is placed under a high frequency band environment such as that of the microwave band. Therefore, if the filter stage number (i.e., the number of metal rods) is increased up to five stages or more in order to obtain a steep cutoff characteristic, a filtering characteristic having a very low energy loss performance can be obtained in the pass-band.

Figure 15:
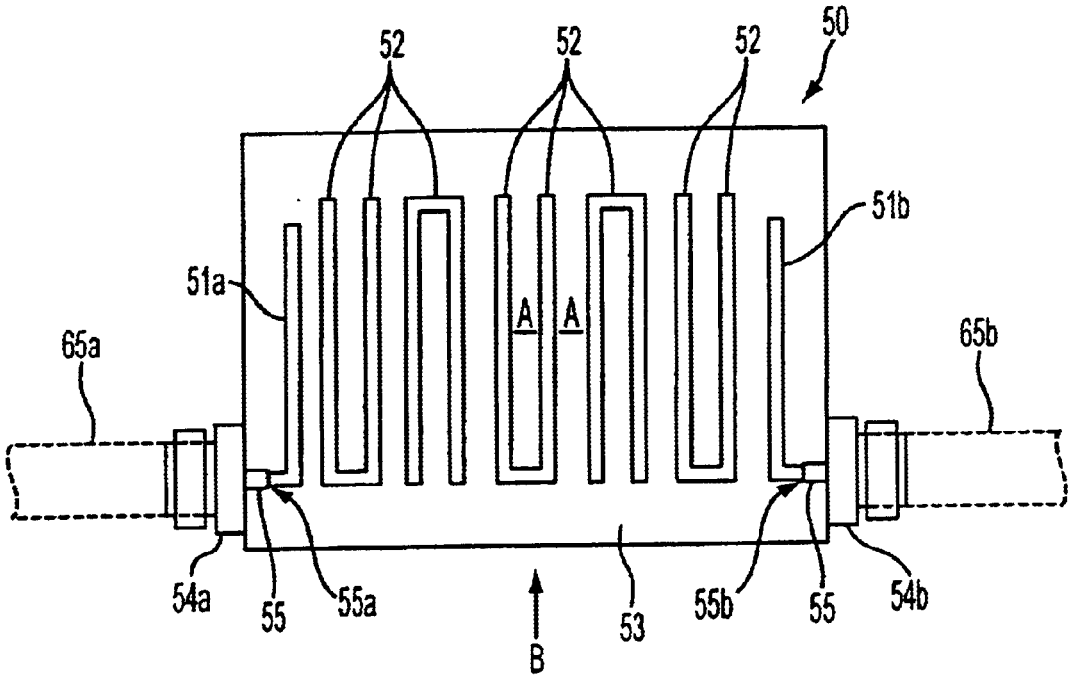
FIG. 15 is a plan view schematically showing a conventional superconductive microstrip filter assembly.
Figure 16:
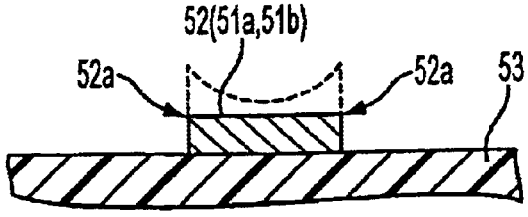
FIG. 16 is a diagram showing a cross section taken along line A—A of a conventional superconductive film shown in FIG. 15.
Figure 17:
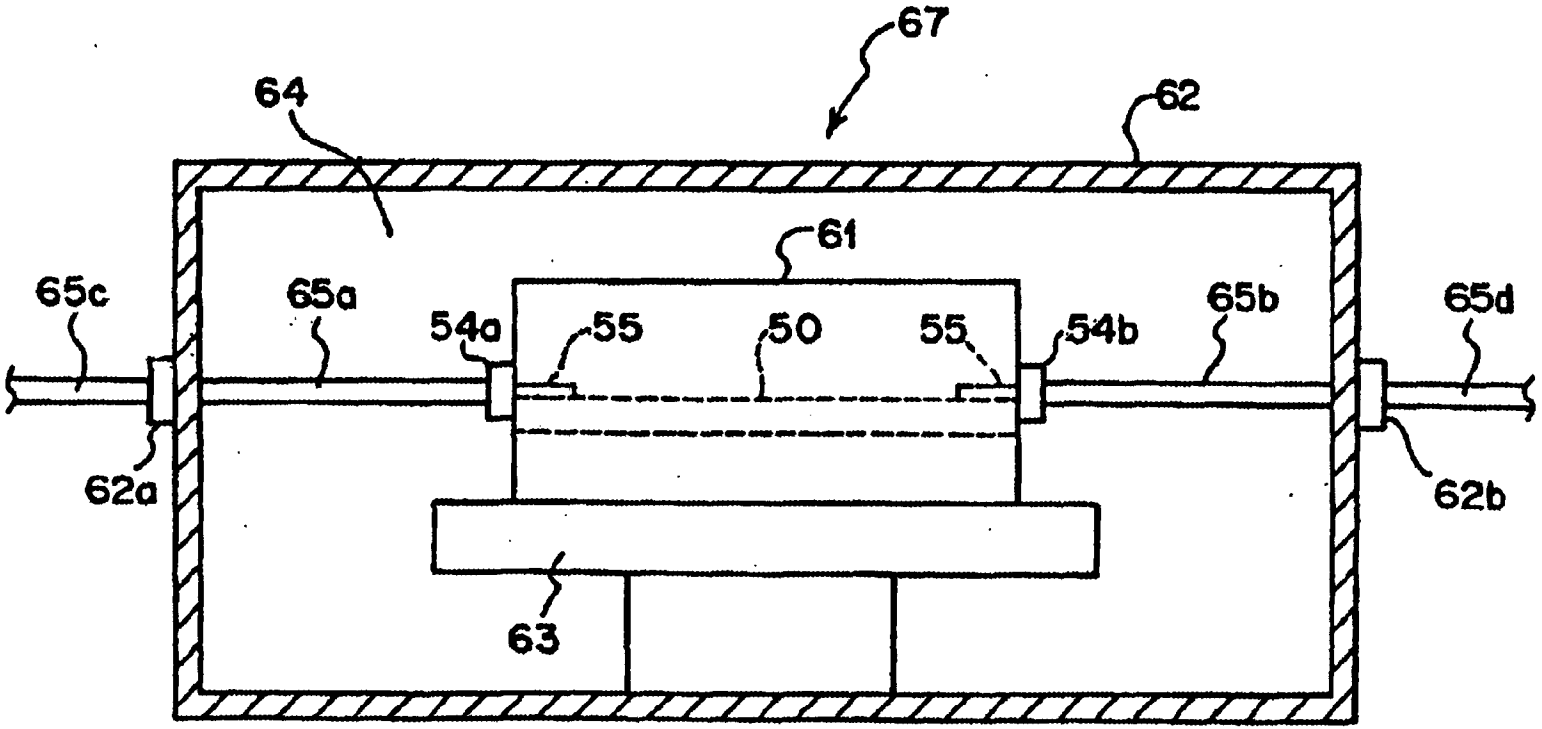
FIG. 17 is a side view schematically showing a conventional superconductive filter module having a superconductive micro-strip filter assembly in which only a vacuum heat insulating vessel is shown in a cross-sectional manner.

Since each of the metal rods 23 has a circular cross-section, the surface current will be dispersed, with the result that it becomes possible to suppress the lowering of Q-value or the lowering of power withstand performance due to the "edge effect" which can be observed in the superconductive microstrip filter 50 of the conventional flat structure (see FIG. 15). Therefore, it becomes possible to realize a filter (band-pass filter) with a very low energy loss performance and a power withstand performance of several tens to several hundred watts or more which is sufficient as a transmission filter.

The frequency adjusting screw (center frequency adjusting member) 24 is used to adjusting the space amount formed between the inner wall 22 of the housing 21 and the other end portion 23*b* (see FIG. 2) of the metal rod 23 so that the coupling capacity created between the inner wall 22 of the housing 21 and the other end portion 23*b* is adjusted. In this way, the center frequency of the band-pass filter 1 (filtering frequency) can be adjusted.

The coupling coefficient adjusting screw (bandwidth adjusting member) 26 is a member for adjusting the space amount formed between each of the metal rods 23 so that a coupling capacity is created between each of the metal rods 23. In this way, the band width (passing band) of the band-pass filter 1 (filtering frequency) can be adjusted. Due to the adjusting screws 24 and 26, the superconductive filter assembly 1 can be subjected to a desired filtering frequency adjustment with ease.

In the present embodiment, also the respective adjusting screws 24 and 26 (at least a portion thereof projecting into the internal space of the housing 21) are made of a known ordinary conductive material such as copper. As, for example, schematically shown in FIG. 4, the adjusting screws have silver metal plating 24A and 26A applied on the surface thereof, and superconductive films 24B and 26B employing a superconductive material (BSCCO) are formed on the surface of the silver metal plating 24A and 26A. In FIG. 2, screw threads of the adjusting screws 24A and 26A are not illustrated.

As described above relative to FIG. 4, according to the arrangement of the superconductive filter 1, since the internal components of the housing 21 have the metal (silver) plating 21A, 23A, 24A and 26A applied, even if the filter assembly is placed under a normal temperature, the center frequency of the filtering frequency, the width of the pass-band or the like can be adjusted by using the adjusting screws 24 and 26. Therefore, the filtering frequency can be adjusted in a room temperature environment in advance with an estimated deviation, which will be caused when the superconductive filter assembly 1 is placed and operated under a low temperature state (superconductive state).

When the filtering frequency is adjusted in the superconductive filter assembly 1 of the present embodiment, the adjusting screws 24 and 26 are adjusted so that the center frequency becomes 2 GHz and the width of pass-band becomes 20 MHz, for example. Further, these adjusting members 24 and 26 are not necessarily formed of a screw, but any member can be employed so long as the member can function as the above-described filtering frequency adjusting member.

As shown in FIG. 1, the signal coupling unit 25*a* (25*b*) is arranged to have a metal plate 40 (made of copper, for example) of a disk shape as a signal coupling plate member. As for example schematically shown in the cross-section of FIG. 3, if the connector 27*a* (27*b*) is connected (engaged) with the coaxial cable 5*a* (5*b*), a center conductor 101 of the coaxial cable 5*a* (5*b*) and the metal plate 40 are electrically connected to each other through a center conductor 27*c* of the connector 27*a* (27*b*).

In this way, the signal coupling unit 25*a* can transmit effectively the microwave transmitted through the coaxial cable 5*a* by way of the metal plate 40 functioning as a plane antenna into the housing 21. Conversely, the signal coupling unit 25*b* can receive (extract) effectively the signal of the particular frequency band which is resonated in the metal rods 23 within the housing 21, and propagated therefrom by means of the metal plate 40 also functioning as a plane antenna. Thus, the signal of the particular frequency band can be transmitted to the coaxial cable 5*b*.

Figure 3:
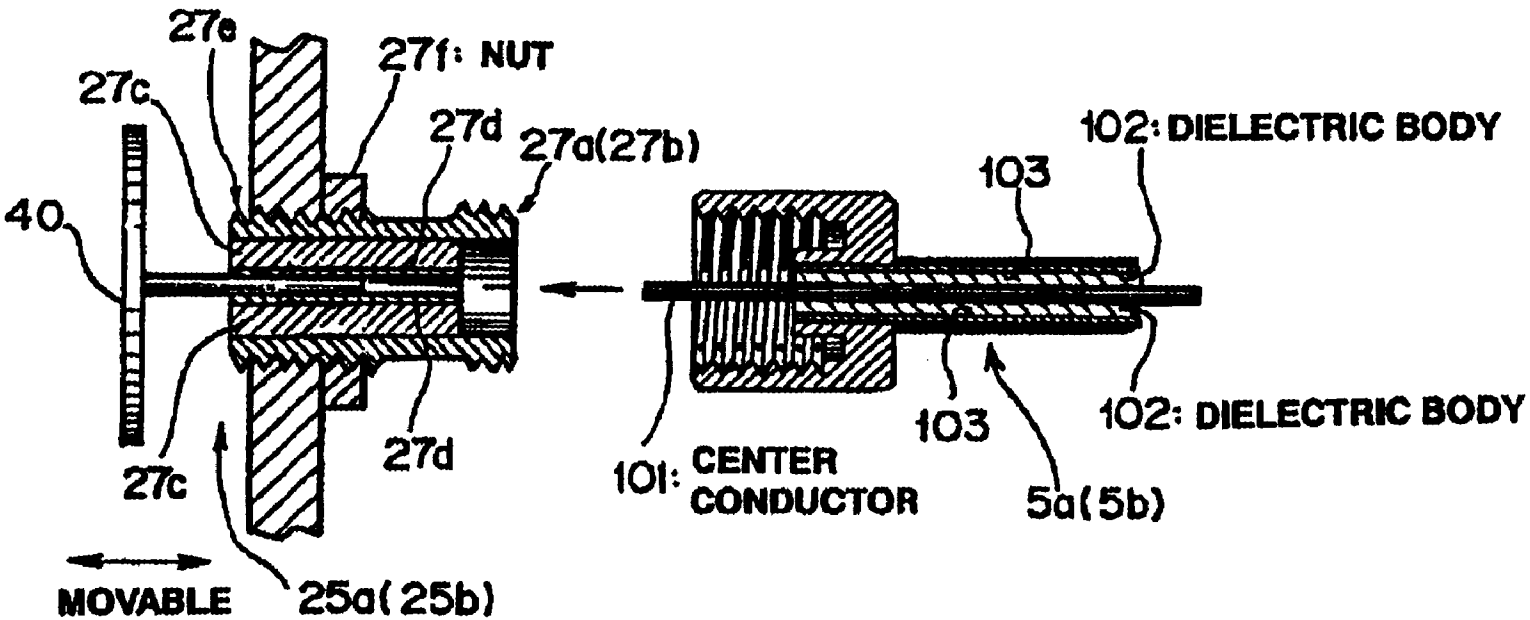
FIG. 3 is a diagram schematically showing a cross section of a connector portion provided in the superconductive filter assembly shown in FIGS. 1 and 2.

As shown in FIG. 3, the connector 27*a* (27*b*) is engaged at its own external thread portion 27*e* with the housing 21. Thus, the connector can be properly adjusted in the distance (coupling coefficient) with respect to the metal rods 23 (not shown) opposite the signal coupling unit 25*a* (25*b*) (i.e., the connector is movable). However, the connector is fastened by a nut 27*f*. In FIG. 3, reference numeral 27*c* represents an insulating member such as a dielectric material coating the center conductor 27*d* of the connector 27*a* (27*b*).

As shown in FIGS. 1 and 2, these signal coupling units 25*a* and 25*b* are brought into a spatial coupling state (non-contact state) with respect to the opposing metal rods 23, respectively. Therefore, it becomes possible to prevent the heat conducted through the center conductor 101 of the coaxial cables 5*a* and 5*b* from being conducted to the metal rods 23.

The signal coupling units 25*a* and 25*b* may have a superconductive film formed on the surfaces thereof, and similarly the inner wall 22 of the housing 21, the metal rods 23, and the adjusting screws 24 and 26. However, as described above, heat is conducted through the center conductor 101 of the coaxial cables 5*a* and 5*b* up to the signal coupling units 25*a* and 25*b*. Therefore, it is difficult to maintain the superconductive state, with the result that there is no advantage as compared with a case where the superconductive film is not formed.

Figure 5:
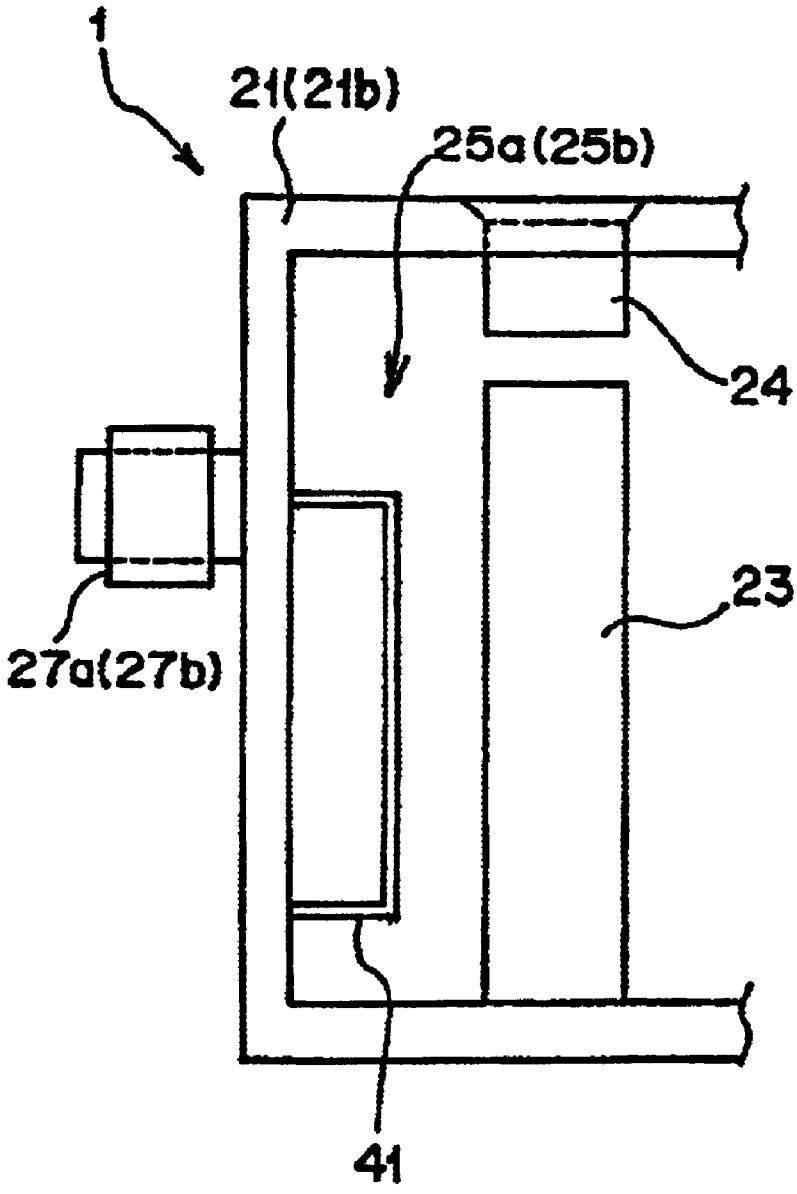
FIG. 5 is a partial plan view schematically showing a signal coupling unit provided in the superconductive filter assembly shown in FIGS. 1 and 2 to which reference is made for explaining an arrangement thereof.

The metal plate 40 of a disk shape provided as the signal coupling units 25*a* and 25*b* may be replaced with a loop-shaped metal wire 41 (e.g., made of copper wire) as a signal coupling loop member, as schematically shown in a plan view of FIG. 5. That is, the signal coupling units 25*a* and 25*b* may be formed of any member having an arbitrary shape so long as the member is attached to the housing and spaced apart from the opposing metal rods 23 and the member can achieve signal coupling with the metal rods 23. Also in FIG. 5, screw threads of the adjusting screws 24 are not illustrated.

As described above, according to the superconductive filter assembly 1 of the present embodiment, the inner wall 22 of the housing 21, the metal rods 23 and the adjusting screws 24 and 26 are arranged so as to have the superconductive films 21*b*, 23*b*, 24*b* and 26*b* formed on the surfaces thereof. Therefore, if the filter stage number is further increased in order to obtain a steep cutoff characteristic, the filtering characteristic of the very low energy loss performance in the pass-band can be obtained, as compared with a case in which the superconductive film 23*b* is formed only on the metal rods 23 functioning as a resonator.

An example of a manufacturing process of the superconductive filter assembly 1 described above will be hereinafter described.

Initially, as shown in FIG. 1, the housing 21 is placed in a state in which the lid 21*c* and the vessel 21*d* are separated from each other. Then, the metal rods 23, the frequency adjusting screws 24 and the coupling coefficient adjusting screws 26 are provided within the vessel 21*d*. There after, silver metal plating 21A, 23A, 24A, and 26A are applied on the surfaces of the inner wall 22 of the vessel 21*d*, the metal rods 23 and respective adjusting screws 24 and 26.

The superconductive material (BSCCO) is applied on the surfaces thereof to form the superconductive films 21B, 23B, 24B, and 26B. Finally, the connectors 27*a* and 27*b* and the signal coupling units 25*a* and 25*b* are attached to the vessel 21*d*, and the vessel 21*d* and the lid 21*c* are combined together using screws, for example. Thus, the superconductive filter assembly 1 is completed.

A method for forming the superconductive films 21B, 23B, 24B and 26B may be as follows. That is, for example, the superconductive material (BSCCO) is dissolved in a desired solvent to make a paste-like material. An object to be coated (housing 21) is dipped in the paste-like material so that the superconductive material is applied to the object. Then, the object is placed in an atmosphere so as to effect a heat treatment at a suitable temperature depending on the superconductive material. The above manufacturing process is merely an example. Therefore, any manufacturing process can be employed so long as the superconductive filter assembly 1 described above is finally completed.

Further, the superconductive material may be any material other than BSCCO so long as the material is a superconductive material. For example, the superconductive material may be any one of the following materials (chemical compounds) having a composition denoted as (1) to (6). In this case, in the following compositions, reference symbol Y represents yttrium, Ba barium, Cu copper, O oxygen, Nd neodymium, Bi bismuth, Sr strontium, Ca calcium, Pb lead, Hg mercury, and Tl thallium.

(1) YBCO (Y—Ba—Cu—O)
(2) NBCO (Nd—Ba—Cu—O)
(3) BSCCO (Bi—Sr—Ca—Cu—O)
(4) BPSCCO (Bi—Pb—Sr—Ca—Cu—O)
(5) HBCCO (Hg—Ba—Ca—Cu—O)
(6) TBCCO (Tl—Ba—Ca—Cu—O)

The above silver plating 21A, 23A, 24A, and 26A may be gold plating using gold type material nickel plating using a nickel type material. Furthermore, the ordinary conductive material employed for the inner wall 22 of the housing 21, the metal rods 23, the adjusting screws 24 and 26 and so on may be a nickel type material such as nickel, nickel alloy or the like.

However, if the material for the metal plating 21A, 23A, 24A, and 26A is determined, selection for the superconductive material can be somewhat limited from the feasibility standpoint of formation of the superconductive film 21B, 23B, 24B and 26B on the surface of the metal plating. Therefore, it is preferable to select the most appropriate combination between the metal plating material and the superconductive material based on the consideration of the matching between the metal plating material and the superconductive material.

In the above example, the metal plating 21A, 23A, 24A, and 26A applied on all of the inner wall 22 of the housing 21, the metal rods 23, and the adjusting screws 24 and 26 are silver plating, and the superconductive material utilized for all of the superconductive film 21B, 23B, 24B and 26B on the surface of the metal plating is BSCCO. However, some of the metal plating and some of the superconductive material may be made of different material. Alternatively, all of the metal plating and all of the superconductive material may be made of different materials. For example, each of the superconductive materials has its own inherent characteristics such that the feasibility of the superconductive film formation depends on the desired shape of the film. Therefore, the material of the superconductive film shall be selected depending on the shape of the place on which the film is to be formed, based on consideration of the characteristics.

Further, the above-described silver plating 21A, 23A, 24A, and 26A may be obviated and the superconductive film 21B, 23B, 24B and 26B may be directly applied to the portion made of the ordinary conductive material. Further, the portion on which the superconductive film 21B, 23B, 24B and 26B is to be formed may be made of the superconductive material. In other words, the surfaces of the inner wall 22 of the housing 21, the metal rods 23 and the adjusting screws 24 and 26 may be made of the superconductive material.

Further, all of the surfaces of the inner wall 22 of the housing 21, the metal rods 23 and the adjusting screws 24 and 26 are not necessarily made of the superconductive material. That is, at least the surface of the metal rods 23 as the columnar resonating member may be made of the superconductive material.

Figure 14:
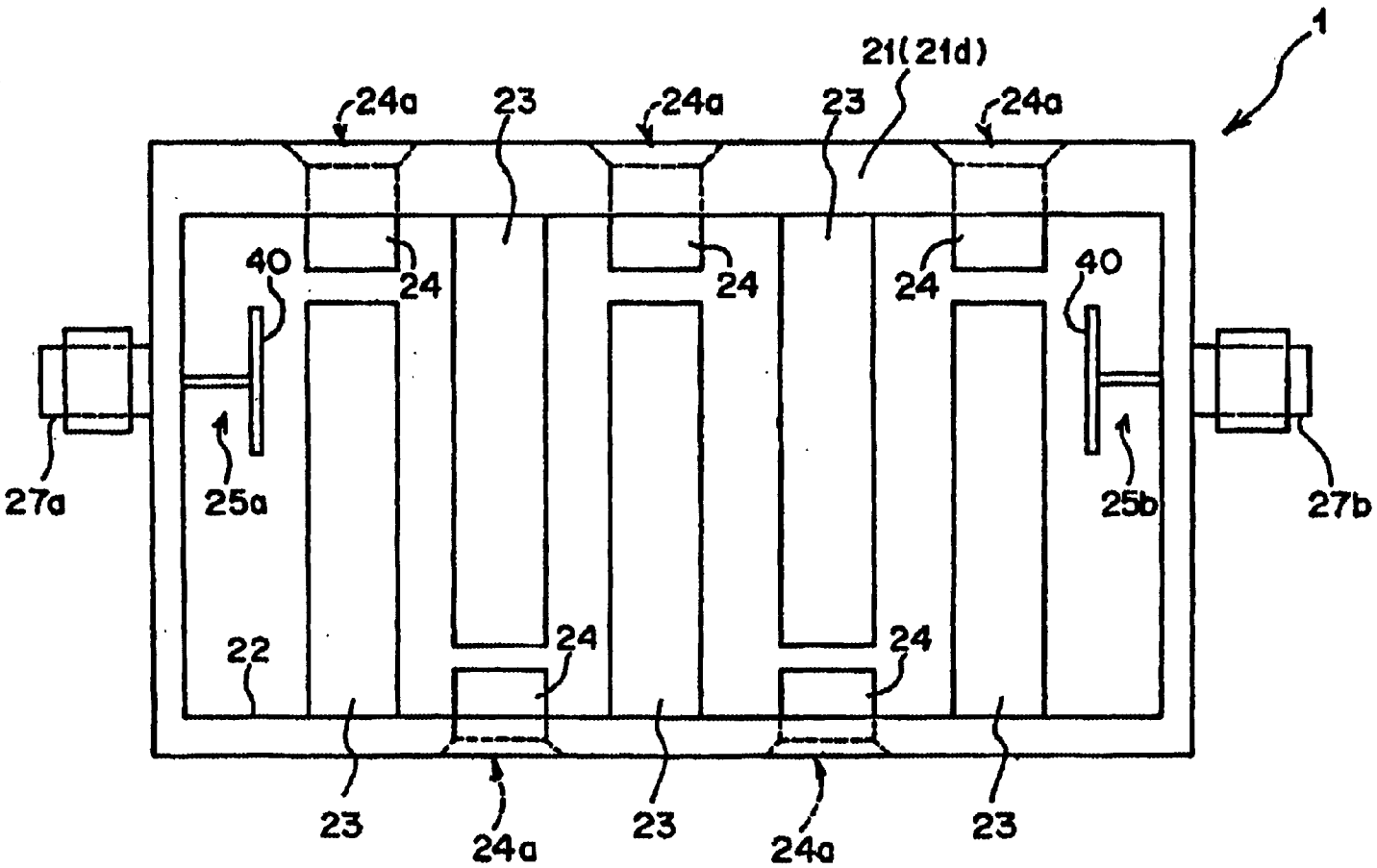
FIG. 14 is a schematic plan view for explaining another structure of the superconductive filter assembly shown in FIGS. 1 and 2.

Further, unlike the structure shown in FIG. 2, the superconductive filter assembly 1 may have a structure shown in FIG. 14, for example. That is, the plurality of metal rods 23 are bonded on the inner wall 22 of the housing 21 so as to be directed at the one end thereof (so as to be formed into a comb shape and be opposed to each other) in an interdigitating fashion. In FIG. 14, the coupling coefficient adjusting screws 26 are not illustrated and the external threads of the frequency adjusting screws 24 are also not illustrated.

The adjusting screws 24 and 26 may be provided on only one side of the housing. Alternatively, the adjusting screws may not be provided at all. Further, the minimum required number of the metal rod (columnar resonating member) 23 is theoretically one.

A position at which the connector 27*a* or 27*b* is provided may not be limited to the position illustrated in FIGS. 1 and 2. The connectors may be provided at any different position so long as a microwave can be introduced into the housing 21 (at the metal rod 23) while the microwave can be extracted from the housing 21 (at the metal rod 23) after the microwave undergoes the filtering.

(B) Description of Superconductive Filter Module

A superconductive filter module including the superconductive filter assembly 1 arranged as described above will be hereinafter described.

Figure 6:
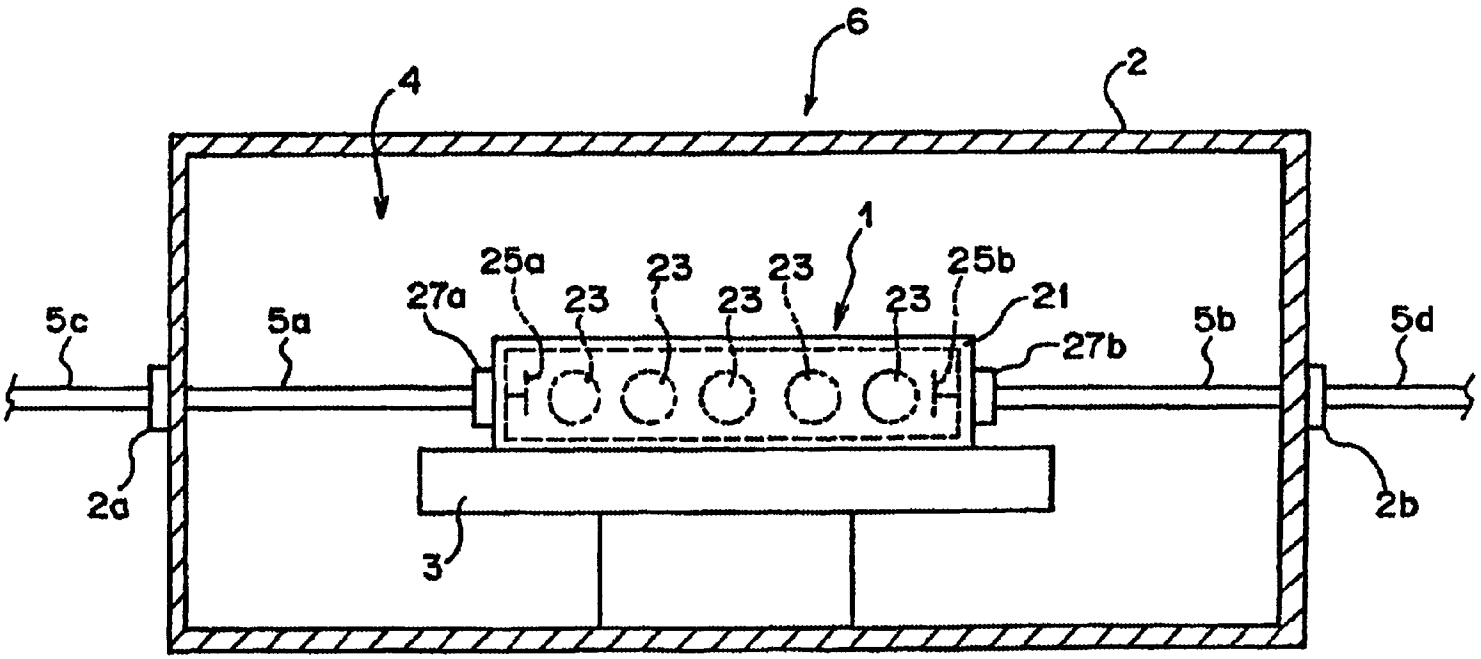
FIG. 6 is a side view schematically showing a superconductive filter module as one embodiment of the present invention in which only a vacuum heat insulating vessel is shown in a cross-sectional manner.

FIG. 6 is a side view schematically showing a superconductive filter module as one embodiment of the present invention in which only a vacuum heat insulating vessel is shown in a cross-sectional manner. As shown in FIG. 6, the superconductive filter module 6 of the present embodiment is arranged to include, for example, a vacuum heat insulating vessel 2 having connectors 2*a* and 2*b* to which coaxial cables (external cables) 5*c* and 5*d* can be connected, the superconductive filter assembly 1 having the above-described arrangement placed (fixed) on a cold head 3 provided within the vacuum heat insulating vessel 2, and the coaxial cables 5*a* and 5*b* of which one ends of each is connected to the input connector 27*a* and output connector 27*b* of the superconductive filter assembly 1 and of which the other ends are respectively connected to the external cables 5*c* and 5*d* through connectors 2*a* and 2*b* of the vacuum heat insulating vessel 2. Reference numeral 4 represents a vacuum space.

The cold head (cooling medium) 3 is connected to a refrigerator not shown. Owing to the refrigerator, the superconductive filter module 6 can be cooled to a temperature of about 70K, for example, so that the superconductive filter assembly 1 can be operated under the superconductive state within the vacuum heat insulating vessel 2. In the present embodiment, heat conductive grease or the like is applied on a contact (fixing) surface between the cold head 3 and the superconductive filter assembly 1 so that intimate contact can be achieved between the cold head and the superconductive filter assembly 1. Thus, a cooling effect can be more stably obtained.

The coaxial cables 5*a* and 5*c* are cables for transmitting a microwave (filter input radio frequency signal) to be inputted to the connector 27*a* of the superconductive filter assembly 1. The coaxial cables 5*b* and 5*d* are cables for transmitting a microwave (filter output radio frequency signal) after undergoing filtering which is to be extracted from the connector 27*b* of the superconductive filter assembly 1. In the present embodiment, the coaxial cables 5*a* and 5*b* involved in the vacuum heat insulating vessel 2 are arranged as a heat insulating type coaxial cable having a cross-sectional structure shown in FIG. 7, for example.

Figure 7:
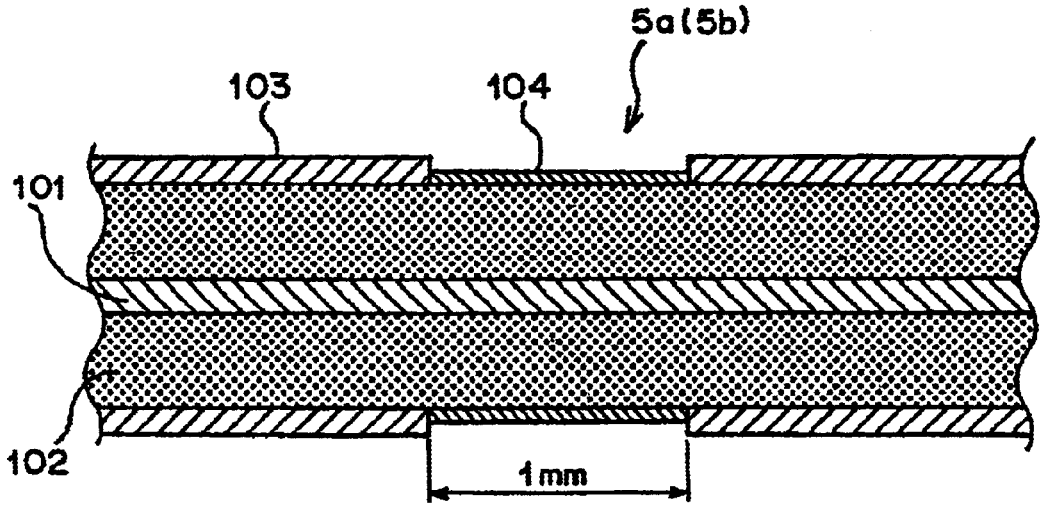
FIG. 7 is a diagram schematically showing a cross section of a heat insulating type coaxial cable as one embodiment of the present invention.

That is, as shown in FIG. 7, the present coaxial cables 5*a* and 5*b* have an external conductor 103, a part of which is removed (e.g., of a length of about 1 mm in its external width), so that a dielectric body is uncovered (exposed). Then, the dielectric body is covered at the exposed portion with a metal plating (e.g., silver plating) 104 having a thickness (hereinafter referred to as surface film thickness) (e.g., 5 $\mu$m) large enough to maintain the electric characteristic as the external conductor.

With this arrangement, the electric characteristic of the coaxial cables 5*a* and 5*b* is ensured. In addition, the silver plating portion 104 is a very thin and hence it has a very small cross-sectional area as compared with the thickness of the external conductor 103. Therefore, the silver plating portion 104 serves as a large heat resistance (heat insulating portion). Accordingly, heat can be effectively suppressed from being conducted (introduced) from the outside of the vacuum heat insulating vessel 2 (i.e., external cables 5*c* and 5*d*). In FIG. 7, reference numeral 101 represents the center conductor and reference number, 102 represents the dielectric body (insulating member) coating the center conductor 101.

That is, each of the coaxial cables 5*a* and 5*b* is composed of the center conductor 101, the dielectric body 102 coating the center conductor 101, and the external conductor 103 coating the dielectric body 102 so that a part of the periphery of the dielectric body is exposed. Further, each of the coaxial cables is composed of the metal plating 104 provided at the exposed peripheral portion of the dielectric body 102 as a heat insulating portion so that the metal plating has a thickness smaller than the thickness of the external conductor 103 coating the dielectric body 102 on the outer periphery thereof.

The above silver plating 104 maybe replaced with any plating such as gold plating, copper plating or nickel plating, for example, as long as the metal plating does not degrade the electric characteristics of the coaxial cables 5*a* and 5*b*.

In the superconductive filter module 6 of the present embodiment arranged as described above, the superconductive filter assembly 1 is cooled to a low temperature of about 70K by a refrigerator by way of the cold head 3 provided in the vacuum heat insulating vessel 2. At this time, the center conductors 101 of the coaxial cables 5*a* and 5*b* have no treatment applied thereon. Therefore, heat tends to flow from the center conductor of the coaxial cables 5*c* and 5*d* which are exposed in an atmosphere at room temperature outside the vacuum heat insulating vessel 2, through the center conductor 101 of the coaxial cables 5*a* and 5*b* into the superconductive filter assembly 1.

However, according to the arrangement of the superconductive filter assembly 1 of the present invention, each of the connectors 27*a* and 27*b* (signal coupling units 25*a* and 25*b*) and the metal rods 23 are spatially coupled to each other with a space interposed therebetween. In addition, the space is a vacuum space. Therefore, heat which tends to flow through the center conductor 101 of the coaxial cables 5*a* and 5*b*, can be prevented from being conducted into the assembly at the signal coupling units 25*a* and 25*b*.

Accordingly, the resonating unit (metal rods 23) within the superconductive filter assembly 1 is placed under a desired low temperature state, and hence the superconductive state is stably and satisfactorily maintained. Therefore, drawbacks such as a heat conduction or a contact failure at the coupling portions 55*a* and 55*b*, which have been observed in the conventional superconductive microstrip filter 50 (see FIG. 15) can be avoided, and extremely satisfactory filtering characteristics can be obtained with stability.

Meanwhile, the center conductor 101 of the coaxial cables 5*a* and 5*b* are surrounded with the dielectric body 102 having a small heat conductivity. Therefore, the heat amount flowing from the center conductor 101 through the housing 21 to the refrigerator may be negligible.

In addition, according to the present embodiment, the external conductor 103 of the coaxial cables 5*a* and 5*b* located in the vacuum heat insulating vessel 2 is shaped as described with reference to FIG. 7 (i.e., the metal plating portion 104 functioning as a heat insulating portion is provided). Therefore, heat flowing from the outside of the vacuum heat insulating vessel 2 (external cables 5*c* and 5*d*) can be suppressed to the minimum level. Accordingly, heat flowing into the refrigerator can be suppressed and the refrigerator can be relieved from a heavy load.

In this way, the total heat flow amount flowing through a plurality of coaxial cables, which are necessary for operating the system, into the refrigerator can be suppressed to a level lower than a permissible level of heat flow. Therefore, one refrigerator can cool a plurality of superconductive filter assemblies. Accordingly, when a situation of an actual mobile communication system is considered, it is possible to expect merits of cost reduction, space saving, lowering of electric power consumption or the like.

The metal plating portion 104 of the coaxial cables 5*a* and 5*b* may be provided at a plurality of places of the cables to an extent that the electric characteristics of the coaxial cables 5*a* and 5*b* can be prevented from being degraded in the vacuum heat insulating vessel 12. With this arrangement, a greater heat insulating effect can be expected.

Figure 8:
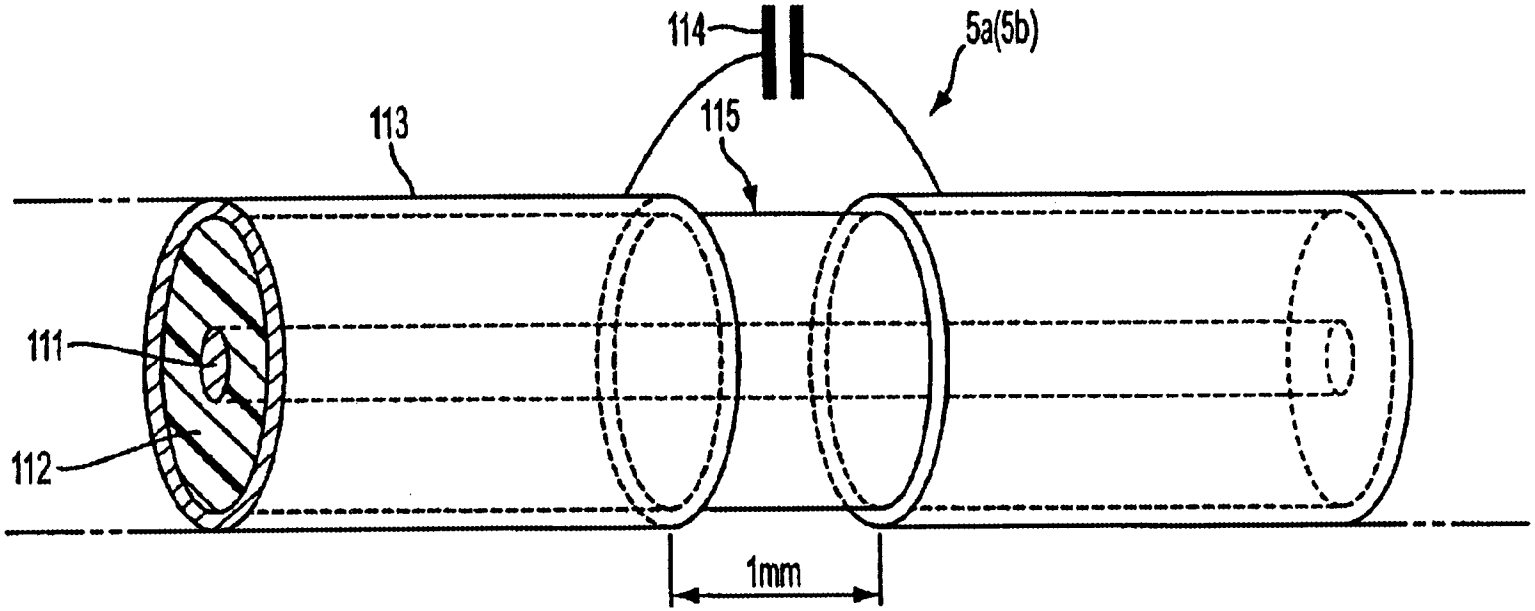
FIG. 8 is a perspective view schematically showing a first modification of the heat insulating type coaxial cable as a present embodiment.

(C) Description of Modifications of Heat Insulating Type Coaxial Cables (C1) Description of First Modification FIG. 8 is a perspective view schematically showing a first modification of the above-described coaxial cable 5*a* (5*b*). As shown in FIG. 8, the coaxial cable 5*a* (5*b*) has an external conductor 113 a part of which (e.g., the peripheral width of about 1 mm) is removed to expose the dielectric body. A capacitor (electrostatic capacity element) 114 having an electrostatic capacity [e.g., in the present embodiment, 10 pF (picofarads)] corresponding to the frequency of the transmitted microwave is connected between the separated external conductor 113. In FIG. 8, reference numeral 111 represents the center conductor of the coaxial cable 5*a* (5*b*), and 112 dielectric body (insulating member) coating the center conductor 111.

That is, the coaxial cable 5*a* (5*b*) of the first modification is arranged to include the external conductor 113 coating the dielectric body 112 so that a part of the periphery of the dielectric body is exposed, and the electrostatic capacity element 114 is provided at the exposed peripheral portion 115 of the dielectric body 112 so that ends of the external conductor 113 coating the dielectric body 112 are coupled to each other.

If the coaxial cable 5*a* (5*b*) has an arrangement of the first modification described above, the capacitor 114 becomes equivalent to a short-circuited (electrically coupled) circuit when a microwave such as one utilized in a mobile communication system is supplied thereat. Therefore, even if the cross-sectional area of the external conductors 113 at the separated portion is small and hence the coupling capacity is very small, the capacitor 114 will compensate for the coupling capacity shortage. Accordingly, the loss of the coaxial cable becomes equivalent to that of an ordinary coaxial cable which has undergone no modification process. Thus, satisfactory electrical characteristics can be maintained in the desired microwave band.

Meanwhile, since a part of the external conductor 113 is removed and the external conductor is divided (disconnected), the exposed peripheral portion 115 of the dielectric body 112 functions as a heat insulating portion. Therefore, the exposed peripheral portion 115 can substantially suppress the heat flow (conduction) from the outside of the vacuum heat insulating vessel 2 (external cables 5*c*, 5*d*).

(C2) Description of Second Modification

Figure 9:
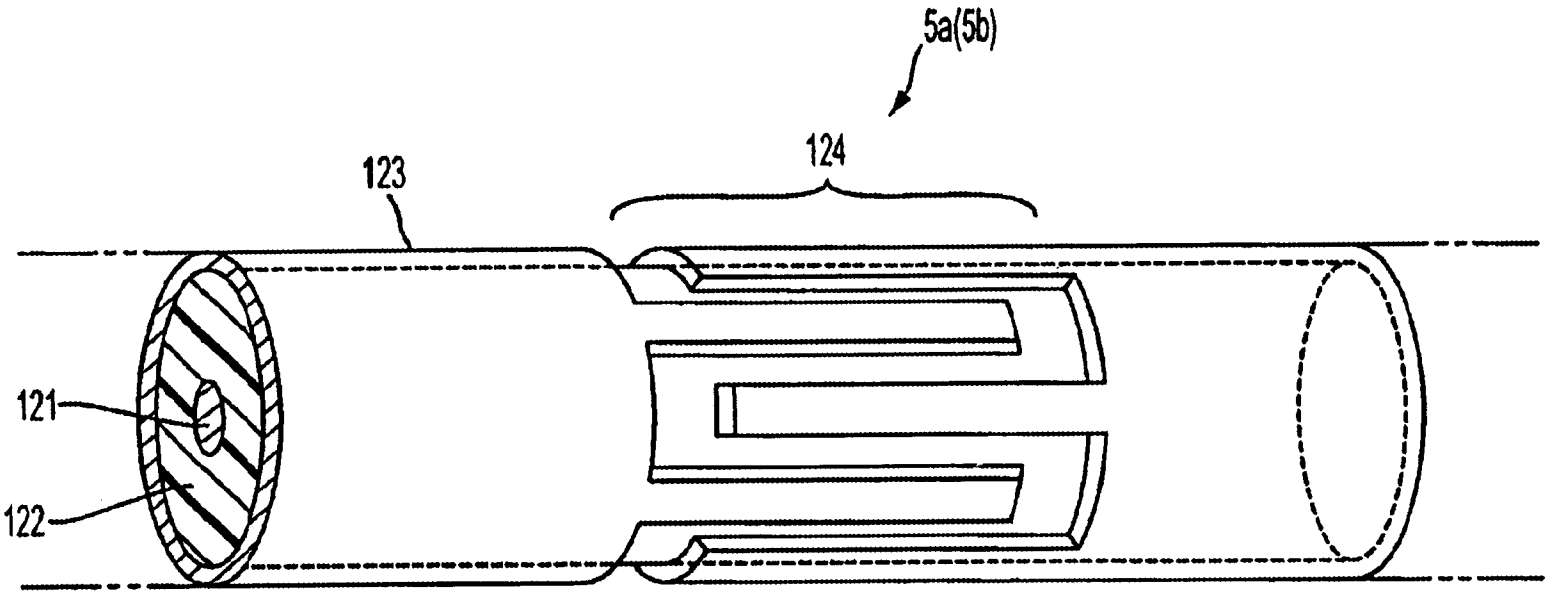
FIG. 9 is a perspective view schematically showing a second modification of the heat insulating type coaxial cable as a present embodiment.

FIG. 9 is a perspective view schematically showing a second modification of the coaxial cable 5*a* (5*b*). As shown in FIG. 9, the coaxial cable 5*a* includes an external conductor 123 a part of which is removed so that a pair of ends are brought into opposition to each other, the opposing ends are formed into comb-shaped portions opposed to each other in an interdigitating fashion, and a part of the dielectric body (insulating member) 122 coating the center conductor 121 is partly exposed. With this arrangement, the areas of the opposing (neighboring) separated ends of the external conductors 123 become large, with the result that it becomes possible to obtain a coupling capacity equivalent to that in a case where the above capacitor 114 is provided.

In other words, according to the arrangement of the coaxial cable 5*a* (5*b*) of the present second modification, the external conductor 123 is arranged to coat the insulating member 122 so that a part of the periphery thereof is exposed, and at the exposed peripheral portion 124 of the insulating member 122, both the opposing ends of the external conductor 123 coating the dielectric body 122 at the periphery thereof are formed into comb-shaped portions and opposed to each other in an interdigitating fashion so that a coupling capacity is created thereat and the opposing external conductor portions formed into the comb-shaped portions is made to serve as the heat insulating portion.

According to the arrangement of the coaxial cable 5*a* (5*b*) of the third modification, electric characteristics can be satisfactorily maintained similarly to the case of the coaxial cable 5*a* (5*b*) of the second modification, without using a separate part such as a capacitor 114. Further, the exposed peripheral portion 124 can suppress heat conduction to the superconductive filter assembly 1. In this case, in particular, since the external conductor 123 is completely separated (cut) at the exposed peripheral portion 124, the heat insulating performance can be further increased.

Also in the first and second modifications, if the above-described heat insulating processing is implemented at a plurality of positions of the cable involved in the vacuum heat insulating vessel 2, the expected heat insulating effect can be more improved. If the heat insulating processing is implemented at a plurality of positions on the cable, several kinds of heat insulating processing described with reference to FIGS. 7 to 9 may be combined and employed (e.g., three portions of heat insulating processing described with reference to FIGS. 7 to 9 are provided so that each of them is involved).

(C3) Description of Third Modification

Figure 10:
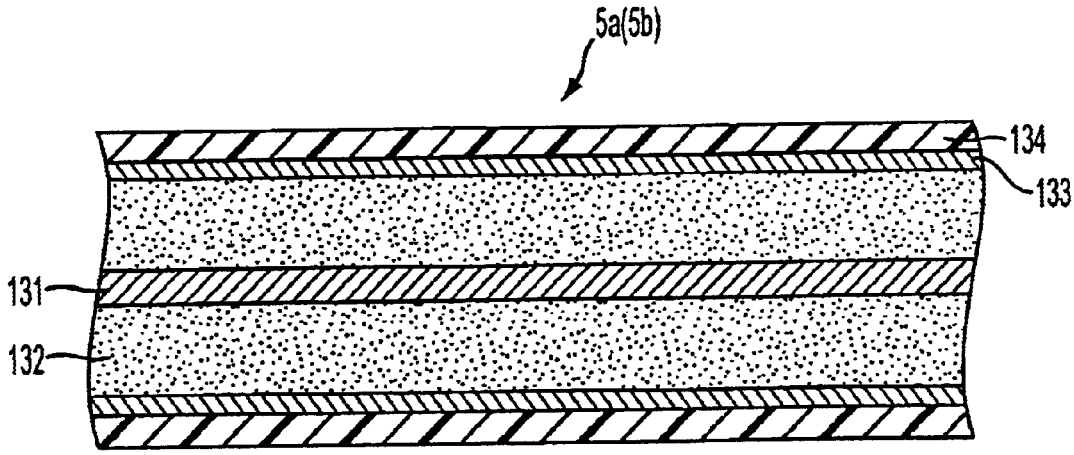
FIG. 10 is a perspective view schematically showing a third modification of the heat insulating type coaxial cable as a present embodiment.

FIG. 10 is a cross-sectional view schematically showing a third modification of the coaxial cable 5*a* (5*b*). As shown in FIG. 10, the coaxial cable 5*a* (5*b*) has a structure whereby a metal plating layer (e.g., copper plating) 133 having a thickness of more than surface skin thickness (e.g., 5 $\mu$m) is provided on the surface of a dielectric body (insulating member) 132 coating a center conductor 131 so that the metal plating extends along the whole length of the cable. Thus, the metal plating serves as an external conductor. Then, the cable is reinforced with a plastic layer 134 provided on the outer periphery of the external conductor.

That is, according to the present third modification, the coaxial cable 5*a* (5*b*) is arranged to include the center conductor 131, the dielectric body (insulating member) 132 coating the center conductor 131, the metal plating layer 133 coating the dielectric body 132, and the plastic layer 134 as a resin layer coating the metal plating layer 133, wherein at least the metal plating layer 133 is made to serve as the heat insulating portion.

According to the coaxial cable 5*a* (5*b*) as the present third modification arranged as described above, a metal plating layer 133 having a thickness of more than the surface skin thickness is provided as the external conductor. Therefore, the electric characteristics can be prevented from being degraded. Further, since the metal plating layer 133 having a very small cross-sectional area is provided so that the metal plating extends along the whole length of the cable 5*a* (5*b*), the heat insulating effect can be very large. Moreover, the coaxial cable is reinforced with the plastic layer 134 coating the metal plating layer 133. Therefore, the physical strength of the coaxial cable 5*a* (5*b*) can be improved.

While in the above example the metal plating layer 133 is made of copper plating, any other metal plating such as silver plating, gold plating, and nickel plating may be applied so long as the coaxial cable can be protected from degradation of its electric characteristics.

(C4) Description of Fourth Modification

Figure 11:
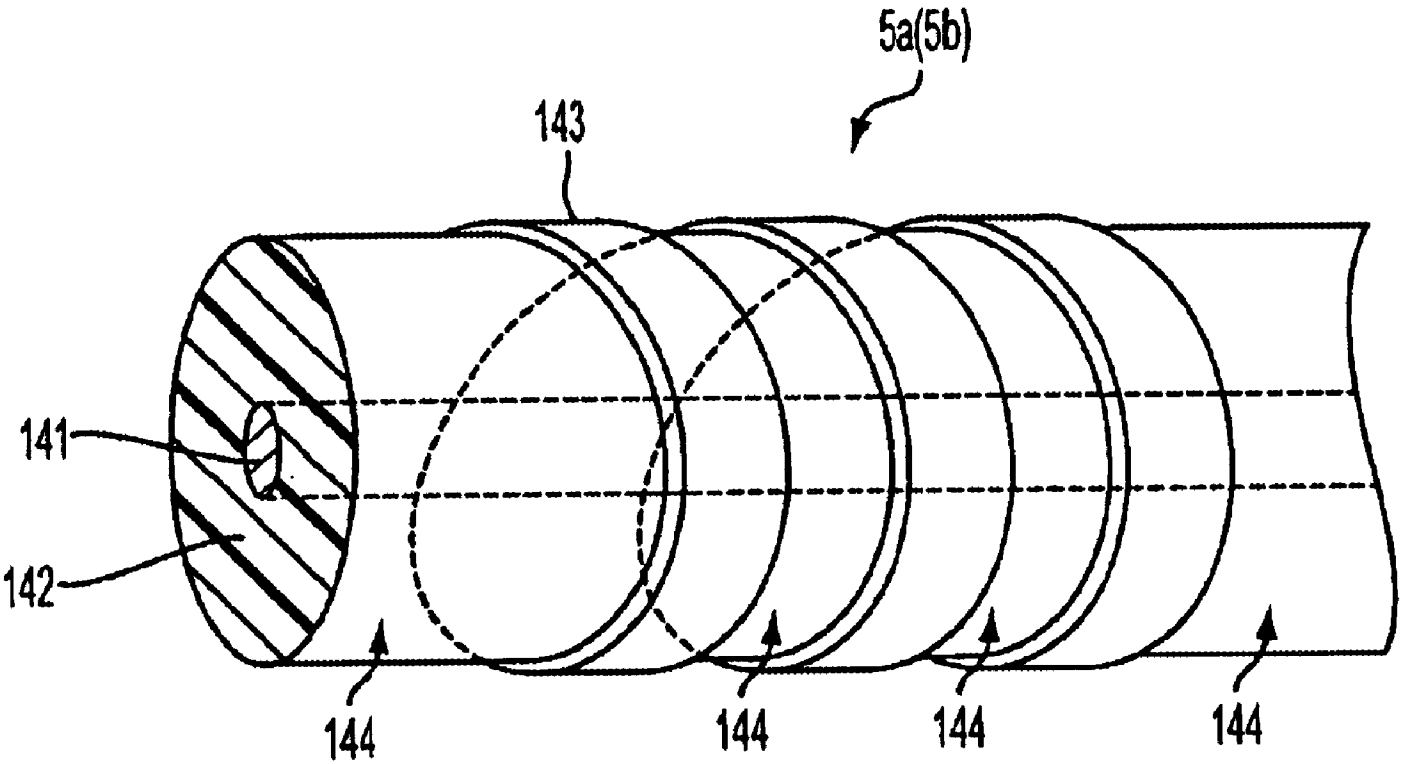
FIG. 11 is a perspective view schematically showing a fourth modification of the heat insulating type coaxial cable as a present embodiment.

FIG. 11 is a perspective view schematically showing a fourth modification of the coaxial cable 5*a* (5*b*). As shown in FIG. 11, the coaxial cable 5*a* (5*b*) is arranged to include a rectangular (strap-like) metal sheet (e.g., copper plate sheet) 143 as an external conductor having a small width of three millimeters, f or example, coiling around a dielectric body (insulating member) 142 coating a center conductor 141 at four millimeters pitch.

That is, according to the present fourth modification, the coaxial cable 5*a* (5*b*) is arranged in such a manner that the copper plate sheet 143 as a strap-like conductive member is coiled around the outer periphery of the dielectric body 142 with a part 144 of the periphery of the dielectric body 142 left uncovered, and the copper plate sheet 143 coiling around the periphery of the dielectric body 142 made to serve as the heat insulating portion.

With this arrangement, heat conducted from the outside of the vacuum heat insulating vessel 2 is conducted along the copper plate sheet 143 as the external conductor coiling around the dielectric body. Therefore, the path for conducting the heat is elongated, and hence a heat insulating effect can be achieved. While the plate sheet 143 is made of copper, the metal sheet may be made of any metal such as silver, gold, nickel or the like. Furthermore, it is needless to say that the pitch at which the metal sheet 143 is coiled around the dielectric body may take any value different from the above value.

(C5) Description of Fifth Modification

Figure 12:
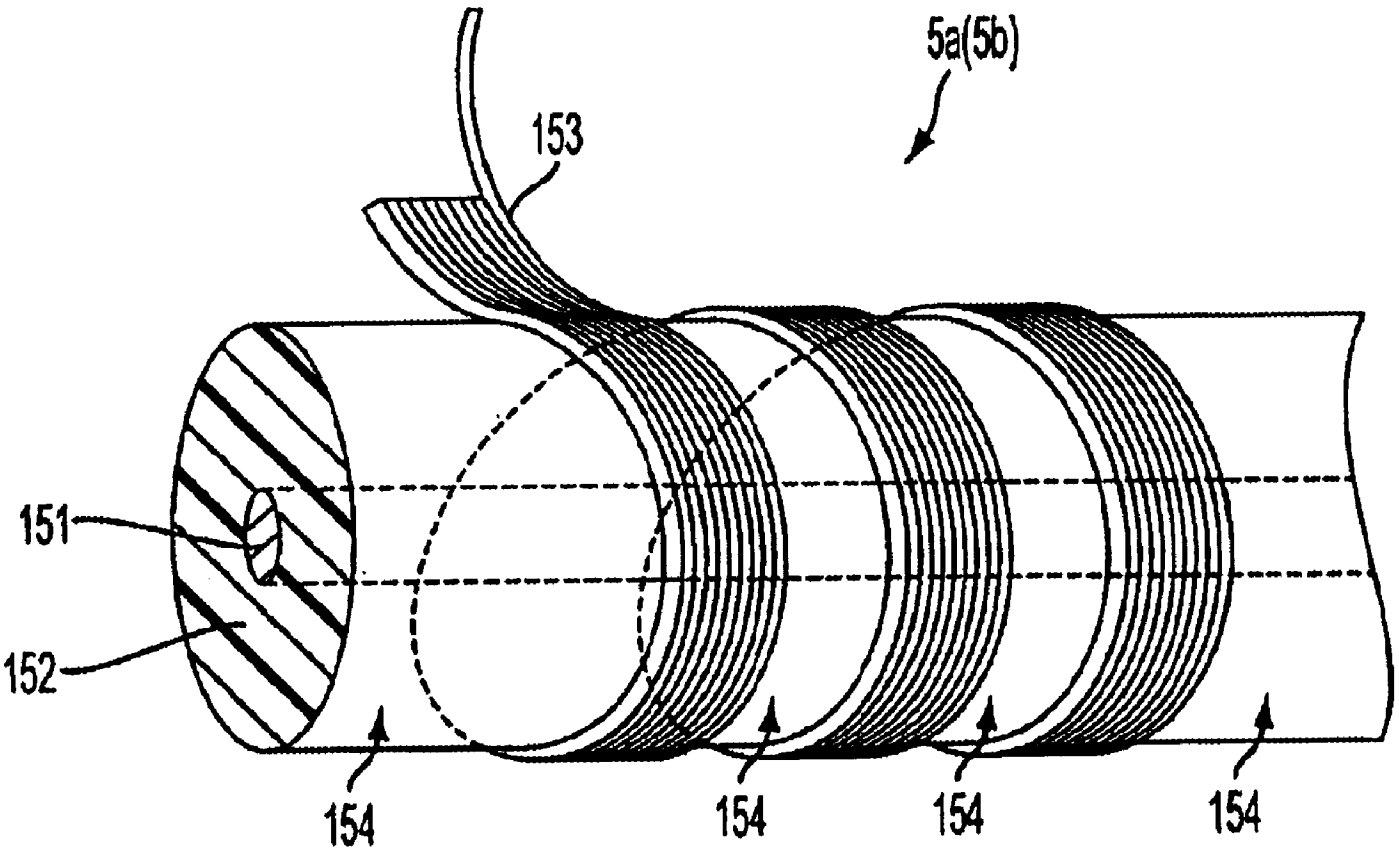
FIG. 12 is a perspective view schematically showing a fifth modification of the heat insulating type coaxial cable as a present embodiment.
Figure 13:
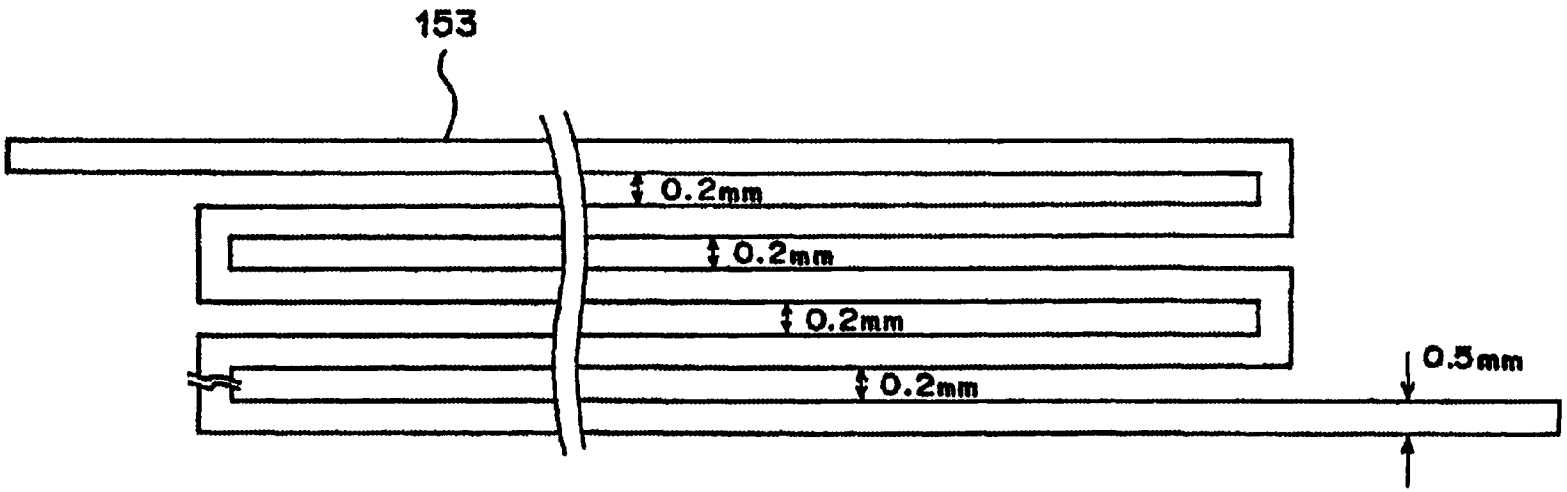
FIG. 13 is a plan view schematically showing a metal sheet formed into a meander-shape employed as an external conductor of the heat insulating type coaxial cable shown in FIG. 12.

FIG. 12 is a perspective view schematically showing a fifth modification of the coaxial cable 5*a* (5*b*). As shown in FIG. 12, the coaxial cable 5*a* (5*b*) is arranged to include a metal sheet (e.g., a copper sheet) 153 formed into a meander-shape (e.g., having a meander width of 0.5 mm and an interline gap of 0.2 mm) as shown in FIG. 13. Similarly to the above-described fourth modification, the metal sheet is coiled around a dielectric body (insulating member) 152 coating the center conductor 151 as an external conductor at a pitch of four millimeters.

That is, according to the coaxial cable 5*a* (5*b*) of the present fifth modification, the external conductor is formed of the copper plate sheet 154 as an external conductor which is formed into a meander-shaped conductive sheet member coiling around the outer periphery of the dielectric body 152 with a part 154 of the periphery of the dielectric body 152 left uncovered, and the copper plate sheet coiling around the periphery of the dielectric body 152 made to serve as the heat insulating portion.

According to the arrangement of the coaxial cable 5*a* (5*b*) as the fifth modification, since the heat conducting path is further elongated as compared with that in the arrangement of the fourth embodiment described above, the heat insulating effect becomes more effective.

Also in this case, the material of the copper plate sheet 153 may be replaced with any metal such as silver, gold, nickel or the like. Furthermore, it is needless to say that the width, the interline gap, the pitch or the like of the meander-form may take any value different from the above value.

The following table shows a result of simulation illustrating how the heat amount conducted through the coaxial cable can be suppressed owing to the heat insulating processing. The condition (environment) of the simulation is such that, for example, in FIG. 6, the temperature of the surrounding atmosphere is 300K, the temperature of the cold head 3 is 70K, and these temperatures are made constant. The length of the coaxial cable 5*a* (5*b*) involved in the vacuum heat insulating vessel 2 is 25 cm, and the outer diameter of the same is 2.2 mm.

TABLE

Result of simulation of heat flowing amount through respective coaxial cables

| | ordinary coaxial cable | #1 | #2 | #3 |
|---|---|---|---|---|
| heat amount flowing (W) | 1.382 | 0.195 | 0.099 | 0.080 |

In the above table, references #1 to #3 represent the following coaxial cables 5a (5b).
#1: The structure of the cable is as shown in FIG. 7, the thickness of the silver plating 104 is 5 μm, and this plating is applied at a peripheral width of about 1 mm.
#2: The structure of the cable is as shown in FIG. 8, and the external conductor 113 is partly cut-way at a peripheral width of about 1 mm.
#3: The structure of the cable is as shown in FIG. 10, copper plating 133 having a thickness of 5 μm is applied thereon, and the copper plating is coated with the plastic layer 134.

In the above table, references #1 to #3 represent the following coaxial cables 5*a* (5*b*).

#1: The structure of the cable is as shown in FIG. 7, the thickness of the silver plating 104 is 5 μm, and this plating is applied at a peripheral width of about 1 mm.

#2: The structure of the cable is as shown in FIG. 8, and the external conductor 113 is partly cut-way at a peripheral width of about 1 mm.

#3: The structure of the cable is as shown in FIG. 10, copper plating 133 having a thickness of 5 μm is applied thereon, and the copper plating is coated with the plastic layer 134.

As will be understood from the above table, the ordinary coaxial cable permits a heat conduction amount of 1.382 W. However, the coaxial cable of #1, or cable having a partial plating structure permits a heat conduction amount of 0.195 W, the coaxial cable of #2, or cable of a capacity coupling type permits a heat conduction amount of 0.099 W, and the coaxial cable of #3, or cable of a whole-plating type permits a heat conduction amount of 0.080 W. That is, all the structures of the above examples remarkably decrease the amount of heat flowing.

As described above, if the coaxial cable 5*a* (5*b*) employs any of the structures described with reference to FIGS. 7 to 12, it becomes possible to effectively suppress the heat amount flowing through the external conductor into the superconductive filter assembly 1. Therefore, in any of the above cases, load imposed on the refrigerator can be decreased. Thus, even if a single refrigerator unit has to cool a plurality of superconductive filter assembles 1, the total amount of heat flowing through the coaxial cables can be suppressed to a permissible level for the refrigerator.

(D) Other disclosure

While in the above-described superconductive filter assembly 1 the metal rod 23 of a columnar shape or a cylindrical shape (i.e., a member having a circular cross-section) is employed, the present invention is not limited to this arrangement. That is, if the metal rod can at least suppress the "edge effect" which was observed in the conventional superconductive micros trip filter 50, and improvement in electric power withstand performance can be expected, then the metal rod may be any member having any cross-section such as an elongated circle, or an elliptical shape or polygonal shape (whether the cross-section of the member is solid or hollow does not matter). Also, the dimensions thereof (the diameter, the area of the cross-section and so on) do not matter.

The above coaxial cables 5*a* and 5*b* may take any structure other than those described with reference to FIGS. 7 to 12 so long as the cable is equipped with a center conductor, a dielectric body (insulating member) coating the center conductor, and an external conductor having a heat insulating portion and attached to the periphery of the dielectric body.

Further, the cable connected to the superconductive filter assembly 1 may not necessarily be a cable such as the coaxial cable 5*a* and 5*b*, but any cable may be employed so long as the cable can transmit a microwave and be provided with the above-described heat insulating portion.

Furthermore, utilization of the above-described coaxial cables 5*a* and 5*b* is not limited to the case where the coaxial cable is connected to the superconductive filter assembly 1. That is, the coaxial cable may be connected to other types of superconductive filter assembly such as a superconductive microstrip filter 50 or the like. Alternatively, the coaxial cable may be connected to any superconductive device at least partially employing a component operated under a superconductive state. Also in this case, a heat insulating effect similar to that described above can be obtained.

The present invention is not limited to the above-described embodiments but various changes and modifications can be effected without departing from the gist of the present invention.

Industrial Applicability

As described above, according to the superconductive filter module and superconductive filter assembly, steep cutoff characteristic can be obtained with stability, and a filter having an excellent power withstand performance can be implemented. Therefore, the superconductive filter module and superconductive filter assembly according to the present invention can satisfactorily respond to the effective utilization of band which is required with the rapid increase in the number of mobile communication users. Moreover, the superconductive filter module and superconductive filter assembly according to the present invention can be applied to a transmission filter for use in a base station which is requested to have a high power withstand performance. Accordingly, it is considered that the utility thereof is extremely high.

Further, according to the heat insulating type coaxial cable of the present invention, since the external conductor is provided with a heat insulating portion, if the cable is utilized as a connection cable for use with a superconductive device such as a superconductive filter assembly or the like, then the heat conduction to the superconductive device can be effectively suppressed. Accordingly, a refrigerator can stably maintain the superconductive device in a superconductive state with a small load for cooling. Therefore, it is considered that the utility thereof is extremely high.

What is claimed is:

1. A heat insulating type coaxial cable connectable to a superconductive device including at least one element which is operated under a superconductive state, comprising:

a center conductor;

an insulating member coating the center conductor; and an external conductor attached to the outer periphery of the insulating member and provided at a proper position thereof with a heat insulating portion capable of insulating heat from being conducted into the superconductive filter assembly, wherein the external conductor is composed of a metal plating layer coating the insulating member at the periphery thereof and a resin layer coating the metal plating layer, and the metal plating layer having a cross-sectional area much smaller than that of the canter conductor and the insulating member to serve as the heat insulating portion having a larger heat resistance to resist heat transmission on the metal plating layer.

2. A superconductive filter module comprising:

a vacuum heat insulating vessel;

a superconductive filter assembly provided in the vacuum heat insulating vessel and composed of a filter housing having a signal input connector at which a filter input radio frequency signal is inputted and a signal output connector from which a filter output radio frequency signal is outputted and at least one columnar resonating member attached to an inner wall of the filter housing at one end thereof so as to be spaced apart from the signal input connector and the signal output connector so that a filter output radio frequency signal component outputted from the signal output connector selected from the filter input radio frequency signal components inputted through the signal input connector is brought into a resonance mode in the filter housing, the columnar resonating member being coated with a superconductive material on at least the surface thereof;

a cooling medium provided in the vacuum heat insulating vessel so that the superconductive filter assembly is disposed thereon, and capable of cooling the superconductive filter assembly so that the superconductive filter assembly can be operated under a superconductive state;

a signal input cable connected to the signal input connector of the superconductive filter assembly so that a filter input radio frequency signal to be inputted into the signal input connector can be transmitted to the inside of the filter assembly, the signal input cable having a heat insulating portion capable of insulating heat conductance into the superconductive filter assembly provided at a proper portion within the vacuum heat insulating vessel; and a signal output cable connected to the signal output connector of the superconductive filter assembly so that a filter output radio frequency signal extracted from the signal output connector can be transmitted to the outside of the filter assembly, the signal output cable having a heat insulating portion capable of insulating heat conductance into the superconductive filter assembly provided at a proper portion within the vacuum heat insulating vessel, wherein each of the filter housing and said at least one columnar resonating member is comprised of conductive material, the inner wall of the filter housing and the surface of the at least one columnar resonating member have a metal plating, and a superconductive film comprised of superconductive material is disposed on a surface of the metal plating.

3. A superconductive filter module according to claim 2, wherein said at least one columnar resonating member has one of a circular cross-section, an elliptical cross-section and a polygonal cross-section.

4. A superconductive filter module according to claim 2, wherein the filter housing has on the inner wall thereof a center frequency adjusting member for adjusting a space amount between the inner wall of the filter housing and the other end of said at least one columnar resonating member so as to adjust the coupling capacity between the inner wall of the filter housing and the other end of said at least one columnar resonating member, whereby the center frequency of the filtering frequencies can be adjusted, a surface of the center frequency adjusting member being comprised of a superconductive material.

5. A superconductive filter module according to claim 4, wherein the center frequency adjusting member is comprised of conductive material, the surface of the center frequency adjusting member has metal plating, and a superconductive film comprised of superconductive material is disposed on the surface of the metal plating.

6. A superconductive filter module according to claim 2, wherein said at least one columnar resonator comprises a plurality of such columnar resonating member which are provided having a regular interval interposed therebetween so as to provide an array of said columnar resonating members on the inner wall of the filter housing, and the filter housing has on the inner wall thereof a plurality of bandwidth adjusting members for adjusting a space amount between the inner wall and the columnar resonating members so as to adjust the coupling capacity therebetween, whereby a bandwidth of the filtering frequencies can be adjusted, the a surface of the bandwidth adjusting members being comprised of a superconductive material.

7. A superconductive filter module according to claim 6, wherein said bandwidth adjusting members are made of conductive material, the surface of each bandwidth adjusting member have respective metal plating, and a superconductive film comprised of respective superconductive material is disposed on the surface of the corresponding metal plating.

8. A superconductive filter module according to claim 7, wherein the conductive material includes either copper material or nickel material.

9. A superconductive filter module according to claim 7, wherein the respective metal plating includes any one of silver material, gold material and nickel material.

10. A superconductive filter module according to claim 2, wherein the superconductive material is made of any one of YBCO, NBCO, BSCCO, BSCCO, BPSCCO, HBCCO and TBCCO.

11. A superconductive filter module according to claim 2, wherein the signal input connector and the signal output connector have respective signal coupling units provided in the filter housing so as to be opposed to and be spaced apart from said at least one columnar resonating member, respectively.

12. A superconductive filter module according to claim 11, wherein each of the respective signal coupling units is provided with a signal coupling flat member.

13. A superconductive filter module according to claim 11, wherein each of the respective signal coupling units is provided with a signal coupling loop member.

14. A superconductive filter module according to claim 2, wherein each of the signal input cable and the signal output cable is arranged as a heat insulating coaxial cable composed of a center conductor, an insulating member coating the center conductor, and an external conductor provided on the periphery of the insulating member so as to have a respective hear insulating portion.

15. A superconductive filter module according to claim 14, characterized in that the external conductor is composed of a metal plating layer coating the insulating member at the outer periphery thereof and a resin layer coating the metal plating layer, and at least the metal plating layer also serving as the heat insulating portion.

16. A heat insulating type coaxial cable for use with a superconductive filter assembly including a filter housing having a signal input connector at which a filter input radio frequency signal is inputted and a signal output connector from which a filter output radio frequency signal is outputted, and a columnar resonating member, each of the filter housing and the columnar resonating member is comprised of conductive material, the inner wall of the filter housing and a surface of the columnar resonating member have a metal plating, and the columnar resonating member is coated with a superconductive material on at least a surface thereof so as to bring into a resonance mode in the filter housing, a filter output radio frequency signal component outputted from the signal output connector selected from the filter input radio frequency signal components inputted through the signal input connector, the coaxial cable being connectable to either the signal input connector or the signal output connector, the heat insulating type coaxial cable comprising:

a center conductor;

an insulating member coating the center conductor; and an external conductor attached to the outer periphery of the insulating member and provided at a proper position thereof with at least one heat insulating portion capable of insulating heat from being conducted into the superconductive filter assembly.

17. A heat insulating type coaxial cable according to claim 16, wherein said at least one columnar resonator comprises a plurality of such heat insulating portions which are provided at a plurality of proper positions of the external conductor.

18. A heat insulating type coaxial cable according to claim 16, wherein the external conductor is composed of a metal plating layer coating the insulating member at the periphery thereof and a resin layer coating the metal plating layer, and at least the metal plating layer also serving as the heat insulating portion.

19. A heat insulating type coaxial cable according to claim 16, wherein the external conductor is composed of a metal plating layer coating the insulating member at the periphery thereof and a resin layer coating the metal plating layer, and the metal plating layer having a cross-sectional area much smaller than that of the center conductor and the insulating member, the metal plating layer to serve as the heat insulating portion having a larger heat resistance to resist heat transmission on the metal plating layer.

20. A superconductive filter assembly comprising:

a filter housing;

a signal input connector attached to the filter housing and connectable to a signal input cable for transmitting a filter input radio frequency signal;

a signal output connector attached to the filter housing at a position different from a position at which the signal input connector is attached, and connectable to a signal output cable for transmitting a filter output radio frequency signal; and at least one columnar resonating member attached on an inner wall of the filter housing at one end thereof so as to be spaced apart from the signal input connector and the signal output connector so that a filter output radio frequency signal component selected from the filter input radio frequency signal components is brought into a resonance mode in the filter housing, the at least one columnar resonating member being coated with a superconductive material on at least the surface thereof, wherein each of the filter housing and said at least one columnar resonating member is comprised of conductive material, the inner wall of the filter housing and the surface of the at least one columnar resonating member have a metal plating, and a superconductive film comprised of superconductive material is disposed on a surface of the metal plating.

21. A superconductive filter assembly according to claim 20, wherein the superconductive material is made of any one of YBCO, NBCO, BSCCO, BSCCO, BPSCCO, HBCCO and TBCCO.

22. A superconductive filter assembly according to claim 20, wherein the signal input connector and the signal output connector have signal coupling units provided in the filter housing so as to be opposed to and be spaced apart from the at least one columnar resonating member, respectively.

23. A superconductive filter assembly according to claim 22, wherein each of the respective signal coupling units is provided with a respective signal coupling flat member.

24. A superconductive filter assembly according to claim 22, wherein each of the respective signal coupling units is provided with a respective signal coupling loop member.

25. A superconductive filter assembly according to claim 20, wherein the filter housing has on the inner wall thereof a respective center frequency adjusting member for adjusting the corresponding space amount between the inner wall of the filter housing and the corresponding other end of said at least one columnar resonating member so as to adjust the respective coupling capacity between the inner wall of the filter housing and the corresponding other end of said at least one columnar resonating member, whereby the center frequency of the filtering frequencies can be adjusted, a surface of the respective center frequency adjusting member being comprised of a superconductive material.

26. A superconductive filter assembly according to claim 25, wherein the respective center frequency adjusting member is comprised of conductive material, a respective surface of the center frequency adjusting member has a corresponding metal plating, and a respective superconductive film comprised of superconductive material is disposed on the surface of the corresponding metal plating.

27. A superconductive filter assembly according to claim 20, wherein said at least one columnar resonator comprises a plurality of such columnar resonating members which arc provided with a regular interval interposed therebetween so as to provide an array of said columnar resonating members on the inner wall of the filter housing, and the filter housing has on the inner wall thereof a plurality of bandwidth adjusting members for adjusting a space amount between the inner wall and said columnar resonating members so as to adjust the coupling capacity therebetween, whereby a bandwidth of the filtering frequencies can be adjusted, a surface of each bandwidth adjusting member being comprised of a superconductive material.

28. A superconductive filter assembly according to claim 27, wherein the bandwidth adjusting members are comprised of conductive material, the surface of each bandwidth adjusting member have a respective metal plating, and a respective superconductive film made of superconductive material is disposed on a surface of the corresponding metal plating.

29. A superconductive filter assembly according to claim 28, wherein the conductive material includes either copper material or nickel material.

30. A superconductive filter assembly according to claim 28 wherein the respective metal plating includes any one of silver material, gold material and nickel material.

31. A superconductive filter assembly according to claim 20, wherein said at least one columnar resonating member has one of a circular cross-section, an elliptical cross-section and a polygonal cross-section.

* * * * *